US007037150B2

(12) United States Patent
Morvillo

(10) Patent No.: US 7,037,150 B2
(45) Date of Patent: May 2, 2006

(54) METHOD AND APPARATUS FOR CONTROLLING A WATERJET-DRIVEN MARINE VESSEL

(76) Inventor: Robert A. Morvillo, 79 Massasoit St., Waltham, MA (US) 02454

( * ) Notice: Subject to any disclaimer, the term of this patent is extended or adjusted under 35 U.S.C. 154(b) by 0 days.

(21) Appl. No.: 10/261,048

(22) Filed: Sep. 30, 2002

(65) Prior Publication Data

US 2003/0079668 A1 May 1, 2003

Related U.S. Application Data

(63) Continuation-in-part of application No. 10/213,829, filed on Aug. 6, 2002, and a continuation-in-part of application No. PCT/US02/25103, filed on Aug. 6, 2002.

(60) Provisional application No. 60/325,584, filed on Sep. 28, 2001.

(51) Int. Cl.
*B63H 11/107* (2006.01)

(52) U.S. Cl. ..... 440/40; 114/151

(58) Field of Classification Search ..... 114/144 R, 114/150, 151; 440/40, 41
See application file for complete search history.

(56) References Cited

U.S. PATENT DOCUMENTS

| | | | | |
|---|---|---|---|---|
| 3,756,185 A | | 9/1973 | Breslin | |
| 4,538,997 A | | 9/1985 | Haglund | |
| 4,691,659 A | * | 9/1987 | Ito et al. | 114/144 R |
| 4,747,359 A | * | 5/1988 | Ueno | 114/144 B |
| 4,992,065 A | | 2/1991 | Törneman et al. | |
| 5,031,561 A | | 7/1991 | Nilsson | |
| 5,421,753 A | | 6/1995 | Roos | |
| 5,579,711 A | | 12/1996 | Thomas | |
| 5,664,978 A | | 9/1997 | Howe | |
| 5,713,770 A | | 2/1998 | Ambli | |
| 6,193,571 B1 | | 2/2001 | Burg | |
| 6,230,642 B1 | | 5/2001 | McKenney et al. | |
| 6,234,100 B1 | | 5/2001 | Fadeley et al. | |
| 6,234,853 B1 | | 5/2001 | Lanyi et al. | |
| 6,308,651 B1 | * | 10/2001 | McKenney et al. | 114/144 R |
| 6,363,875 B1 | * | 4/2002 | Griffith et al. | 114/151 |
| 6,386,930 B1 | * | 5/2002 | Moffet | 440/41 |
| 6,401,644 B1 | | 6/2002 | Fadeley et al. | |
| 6,447,349 B1 | | 9/2002 | Fadeley et al. | |
| 6,453,835 B1 | | 9/2002 | Fadeley et al. | |
| 6,604,479 B1 | | 8/2003 | McKenney et al. | |

(Continued)

FOREIGN PATENT DOCUMENTS

DE 4033674 A1 7/1991

(Continued)

OTHER PUBLICATIONS

"Remote Manoevre Controller—Dual Drive and Quadruple Drive Captain's Instruction", Styr—Kontroll Teknik AB, Stockholm Sweden, Jul. 1994.*

(Continued)

*Primary Examiner*—S. Joseph Morano
(74) *Attorney, Agent, or Firm*—Lowrie, Lando & Anastasi, LLP

(57) ABSTRACT

A control system and apparatus for controlling waterjet-driven marine vessels is disclosed. Some aspects allow for generation of a plurality of actuator control signals from a single vessel control signal, such as those provided by vessel control apparatus. A control stick embodiment provides a control apparatus that comprises a shaft moveable in at least one degree of freedom to provide the vessel control signals. Some aspects allow for an intuitive direct movement of the vessel in correspondence to movements of the control apparatus. Yet other aspects allow for locking out on or more degrees of freedom while other degrees of freedom and not locked out.

92 Claims, 30 Drawing Sheets

U.S. PATENT DOCUMENTS

| | | | |
|---|---|---|---|
| 2001/0029134 | A1 | 10/2001 | Moffet |
| 2003/0077954 | A1 | 4/2003 | Serrao et al. |

FOREIGN PATENT DOCUMENTS

| | | | |
|---|---|---|---|
| EP | 0035859 | A2 | 9/1981 |
| EP | 0035859 | A3 | 9/1981 |
| EP | 0778196 | A1 | 6/1997 |
| EP | 0778196 | B1 | 4/2002 |
| WO | WO 01/34463 | A2 | 5/2001 |
| WO | WO 01/34463 | A3 | 5/2001 |

OTHER PUBLICATIONS

SKT Brochure, 1991.

Rolls-Royce A-Series Instruction Manual Kamewa Water Jets, Jun. 26, 2000, pp 15-54.

Servo Commander-Dual Drive Brochure, SKT/Styr-KontrollTeknik AB; BN Marin Elektronik, Sweden (1996).

* cited by examiner

SINGLE JET SYSTEM DIAGRAM

TWIN JET SYSTEM DIAGRAM

SINGLE WATERJET MOTION DIAGRAM

DUAL WATERJET MOTION DIAGRAM

FULL AHEAD BUCKET

FULL REVERSE BUCKET

FULL AHEAD BUCKET

FULL REVERSE BUCKET

LOCKING JOYSTICK
WITH CAM PLUNGER

METHOD AND APPARATUS FOR CONTROLLING A WATERJET-DRIVEN MARINE VESSEL

RELATED APPLICATIONS

The present application claims priority, under 35 U.S.C. §119(e), to U.S. provisional patent application Ser. No. 60/325,584, entitled "Joystick Control System for Waterjet Driven Vessels," which was filed on Sep. 28, 2001, which is hereby incorporated by reference.

This application is a continuation in part of and also claims priority, under 35 U.S.C. §120 to U.S. patent application Ser. No. 10/213,829, entitled "Integral Reversing and Trim Deflector and Control Apparatus," which was filed on Aug. 6, 2002, and which is hereby incorporated by reference, and is a continuation in part of and claims priority to International patent application No. PCT/US02/25103, entitled the same also filed on Aug. 6, 2002 and which designates the United States of America.

TECHNICAL FIELD

The present invention relates to marine vessel propulsion and control systems. More particularly, aspects of the invention relate to control circuits and methods for controlling the movement of a marine vessel having waterjet propulsion apparatus.

BACKGROUND

Marine vessel controls include control over the speed, heading, trim and other aspects of a vessel's attitude and motion. The controls are frequently operated from a control station, where an operator uses control input devices, such as buttons, knobs, levers and handwheels, to provide one or more control input signals to one or more actuators. The actuators then typically cause an action in a propulsion apparatus or a control surface corresponding to the operator's input. Control signals can be generated by an operator, which can be a human or a machine such as a computer or an auto-pilot.

Various forms of propulsion have been used to propel marine vessels over or through the water. One type of propulsion system comprises a prime mover, such as an engine or a turbine, which converts energy into a rotation that is transferred to one or more propellers having blades in contact with the surrounding water. The rotational energy in a propeller is transferred by contoured surfaces of the propeller blades into a force or "thrust" which propels the marine vessel. As the propeller blades push water in one direction, thrust and vessel motion are generated in the opposite direction. Many shapes and geometries for propeller-type propulsion systems are known.

Other marine vessel propulsion systems utilize waterjet propulsion to achieve similar results. Such devices include a pump, a water intake or suction port and an exit or discharge port, which generate a waterjet stream that propels the marine vessel. The waterjet stream may be deflected using a "deflector" to provide marine vessel control by redirecting some waterjet stream thrust in a suitable direction and in a suitable amount.

In some applications, such as in ferries, military water craft, and leisure craft, it has been found that propulsion using waterjets is especially useful. In some instances, waterjet propulsion can provide a high degree of maneuverability when used in conjunction with marine vessel controls that are specially-designed for use with waterjet propulsion systems.

It is sometimes more convenient and efficient to construct a marine vessel propulsion system such that the net thrust generated by the propulsion system is always in the forward direction. The "forward" direction 20, or "ahead" direction is along a vector pointing from the stern, or aft end of the vessel, to its bow, or front end of the vessel. By contrast, the "reverse", "astern" or "backing" directing is along a vector pointing in the opposite direction (or 180° away) from the forward direction. The axis defined by a straight line connecting a vessel's bow to its stern is referred to herein as the "major axis" 13 of the vessel. A vessel has only one major axis. Any axis perpendicular to the major axis 13 is referred to herein as a "minor axis," e.g., 22 and 25. A vessel has a plurality of minor axes, lying in a plane perpendicular to the major axis. Some marine vessels have propulsion systems which primarily provide thrust only along the vessel's major axis, in the forward or backward directions. Other thrust directions, along the minor axes, are generated with awkward or inefficient auxiliary control surfaces, rudders, planes, deflectors, etc. Rather than reversing the direction of a ship's propeller or waterjet streams, it may be advantageous to have the propulsion system remain engaged in the forward direction while providing other mechanisms for redirecting the water flow to provide the desired maneuvers.

One example of a device that redirects or deflects a waterjet stream is a conventional "reversing bucket," found on many waterjet propulsion marine vessels. A reversing bucket deflects water, and is hence also referred to herein as a "reversing deflector." The reversing deflector generally comprises a deflector that is contoured to at least partially reverse a component of the flow direction of the waterjet stream from its original direction to an opposite direction. The reversing deflector is selectively placed in the waterjet stream (sometimes in only a portion of the waterjet stream) and acts to generate a backing thrust, or force in the backing direction.

A reversing deflector may thus be partially deployed, placing it only partially in the waterjet stream, to generate a variable amount of backing thrust. By so controlling the reversing deflector and the waterjet stream, an operator of a marine vessel may control the forward and backwards direction and speed of the vessel. A requirement for safe and useful operation of marine vessels is the ability to steer the vessel from side to side. Some systems, commonly used with propeller-driven vessels, employ "rudders" for this purpose.

Other systems for steering marine vessels, commonly used in waterjet-propelled vessels, rotate the exit or discharge nozzle of the waterjet stream from one side to another. Such a nozzle is sometimes referred to as a "steering nozzle." Hydraulic actuators may be used to rotate an articulated steering nozzle so that the aft end of the marine vessel experiences a sideways thrust in addition to any forward or backing force of the waterjet stream. The reaction of the marine vessel to the side-to-side movement of the steering nozzle will be in accordance with the laws of motion and conservation of momentum principles, and will depend on the dynamics of the marine vessel design.

Despite the proliferation of the above-mentioned systems, some maneuvers remain difficult to perform in a marine vessel. These include "trimming" the vessel, docking and other maneuvers in which vertical and lateral forces are provided.

It should be understood that while particular control surfaces are primarily designed to provide force or motion in a particular direction, these surfaces often also provide forces in other directions as well. For example, a reversing deflector, which is primarily intended to develop thrust in the backing direction, generally develops some component of thrust or force in another direction such as along a minor axis of the vessel. One reason for this, in the case of reversing deflectors, is that, to completely reverse the flow of water from the waterjet stream, (i.e., reversing the waterjet stream by 180°) would generally send the deflected water towards the aft surface of the vessel's hull, sometimes known as the transom. If this were to happen, little or no backing thrust would be developed, as the intended thrust in the backing direction developed by the reversing deflector would be counteracted by a corresponding forward thrust resulting from the collision of the deflected water with the rear of the vessel or its transom. Hence, reversing deflectors often redirect the waterjet stream in a direction that is at an angle which allows for development of backing thrust, but at the same time flows around or beneath the hull of the marine vessel. In fact, sometimes it is possible that a reversing deflector delivers the deflected water stream in a direction which is greater than 45° (but less than 90°) from the forward direction.

Nonetheless, those skilled in the art appreciate that certain control surfaces and control and steering devices such as reversing deflectors have a primary purpose to develop force or thrust along a particular axis. In the case of a reversing deflector, it is the backing direction in which thrust is desired.

Similarly, a rudder is intended to develop force primarily in a side-to-side or athwart ships direction, even if collateral forces are developed in other directions. Thus, net force should be viewed as a vector sum process, where net or resultant force is generally the goal, and other smaller components thereof may be generated in other directions at the same time.

"Trimming" force is a force that is substantially along a vertical axis 22 of the vessel. This force acts to raise 23 or lower 24 the marine vessel, or parts thereof, along the vertical axis 22. Upwards trim force is developed by deflecting water from a waterjet stream in a downward direction, and conversely, downward trim is developed by deflecting at least a portion of the waterjet stream upwards. The various directions and axes described herein will be illustrated in more detail in the Detailed Description section below.

Steering and trimming control surfaces generally do not develop any backing thrust. Steering and trimming surfaces, such as rudders, trim tabs and interceptors provide forces along minor axes of a marine vessel and generally do not redirect any appreciable portion of a waterjet stream in a direction less than 90° from the forward direction. Thus, these trimming and steering surfaces do not develop any significant backing thrust. Accordingly, steering and trimming control surfaces should not be confused with a reversing deflector, as reversing deflectors do provide a deflection of a waterjet stream with enough forward deflection (having a component traveling in a direction less than 90° from the forward direction) to provide backing thrust.

Marine vessel control systems work in conjunction with the vessel propulsion systems to provide control over the motion of the vessel. To accomplish this, control input signals are used that direct and control the vessel control systems. Control input devices are designed according to the application at hand, and depending on other considerations such as cost and utility.

One control input device that can be used in marine vessel control applications is a control stick or "joystick," which has become a familiar part of many gaming apparatus. A control stick generally comprises at least two distinct degrees of freedom, each providing a corresponding electrical signal. For example, as illustrated in FIG. 2, a control stick 100 may have the ability to provide a first control input signal in a first direction 111 about a neutral or zero position as well as provide a second control input signal in a second direction 113 about a neutral or zero position. Other motions are also possible, such as a plunging motion 115 or a rotating motion 117 that twists the handle 114 of the control stick 100 about an axis 115 running through the handle of the control stick 100. Auxiliaries have been used in conjunction with control sticks and include stick-mounted buttons for example (not shown).

To date, most control systems remain unwieldy and require highly-skilled operation to achieve a satisfactory and safe result. Controlling a marine vessel typically requires simultaneous movement of several control input devices to control the various propulsion and control apparatus that move the vessel. The resulting movement of marine vessels is usually awkward and slow, and lacks an intuitive interface to its operator.

Even present systems employing advanced control input devices, such as control sticks, are not very intuitive. An operator needs to move the control sticks of present systems in a way that provides a one-to-one correspondence between the direction of movement of the control stick and the movement of a particular control actuator.

Examples of systems that employ control systems to control marine vessels include those disclosed in U.S. Pat. Nos. 6,234,100 and 6,386,930, in which a number of vessel control and propulsion devices are controlled to achieve various vessel maneuvers. Also, the Servo Commander system, by Styr-Kontroll Teknik corporation, comprises a joystick-operated vessel control system that controls propulsion and steering devices on waterjet-driven vessels. These and other present systems have, at best, collapsed the use of several independent control input devices (e.g., helm, throttle) into one device (e.g., control stick) having an equivalent number of degrees of freedom as the input devices it replaced.

SUMMARY

Accordingly, there is a need for improved control systems in marine vessels. In vessels propelled by waterjets, it is useful to have a more intuitive and less cumbersome control input apparatus that can be used for underway as well as docking and other maneuvers. One aspect of the invention allows for a more direct way of moving a vessel according to a movement of a control stick in an intuitive manner whereby a single movement of the control stick in a single direction provides a plurality of control signals that are delivered to a plurality of control actuators such that the vessel translates in response to the movement of the control stick.

Another aspect of the invention comprises algorithms for controlling the major vessel control actuators (e.g., engine RPM, reversing buckets, bow thruster and waterjet nozzle positions) based on control signals from a control stick to provide vessel movement corresponding to the control stick movement, such that an operator can selectively move the vessel along one axis without movement along another axis. Accordingly:

One embodiment of the present invention is directed to a method for controlling a marine vessel having at least two of a steering nozzle, a reversing bucket and a bow thruster, comprising receiving a vessel control signal from a vessel control apparatus, the vessel control signal corresponding to a movement of the control apparatus along at least one degree of freedom; and generating at least a first actuator control signal and a second actuator control signal corresponding to the vessel control signal; wherein the first actuator control signal is coupled to and controls one of the steering nozzle, the reversing bucket and the bow thruster, and the second actuator control signal is coupled to and controls a different one of the steering nozzle, the reversing bucket and the bow thruster.

Yet another embodiment is directed to a system for controlling a marine vessel having at least two of a steering nozzle, a reversing bucket and a bow thruster, comprising a vessel control apparatus having at least one degree of freedom and providing a vessel control signal corresponding to a movement of the control apparatus along the at least one degree of freedom; and a processor that receives the vessel control signal and provides at least a first actuator control signal and a second actuator control signal, corresponding to the vessel control signal; wherein the first actuator control signal is coupled to and controls one of the steering nozzle, the reversing bucket and the bow thruster, and the second actuator control signal is coupled to and controls a different one the steering nozzle, the reversing bucket and the bow thruster.

Another embodiment is directed to a system for controlling a marine vessel having three of a water jet propulsor, a steering nozzle, a reversing bucket and a bow thruster, comprising a vessel control apparatus which provides at least one vessel control signal corresponding to a movement of the control apparatus along at least one degree of freedom; and a processor that receives the vessel control signal and provides at least a first, second, and third actuator control signals, corresponding to the vessel control signal; wherein the first actuator control signal is coupled to and controls a first actuator which controls one of the water jet propulsor, the steering nozzle, the reversing bucket and the bow thruster, the second actuator control signal is coupled to and controls a second actuator which controls a second, different, one of the water jet propulsor, the steering nozzle, the reversing bucket and the bow thruster and the third actuator control signal is coupled to and controls a third actuator which controls a third, different, one of the water jet propulsor, the steering nozzle, the reversing bucket and the bow thruster.

Still another embodiment is directed to a system for controlling a marine vessel having at least two sets of: at least two steering nozzles, at least two water jet propulsors and at least two reversing buckets, comprising a vessel control apparatus which provides at least one vessel control signal corresponding to a movement of the control apparatus along at least one degree of freedom; and a processor which receives the vessel control signal and provides at least a first set of actuator control signals and a second set of actuator control signals, the first and second sets of actuator control signals corresponding to the vessel control signal; wherein the first set of actuator control signals is coupled to and controls a first set of the at least two steering nozzles, the at least two water jet propulsors and the at least two reversing buckets, the second set of actuator control signals is coupled to and controls a different set of the at least two steering nozzles, the at least two water jet propulsors and the at least two reversing buckets.

Yet another embodiment is directed to a marine vessel control system, comprising a vessel control apparatus that provides a vessel control signal corresponding to movement of the vessel control apparatus along at least one degree of freedom; and a processor that receives the vessel control signal and provides at least a first actuator control signal and a second actuator control signal; wherein the first actuator control signal is coupled to and controls one of a water jet propulsor, a steering nozzle, a reversing bucket and a bow thruster, and wherein the second actuator control signal is coupled to and controls a different one of the water jet propulsor, the steering nozzle, the reversing bucket and the bow thruster to move the vessel primarily in a direction corresponding to the movement of the vessel control apparatus Another embodiment is directed to a marine vessel control apparatus, comprising a control stick having at least a first and a second degree of freedom; and a lockout device that prevents output of a control signal corresponding to at least one degree of freedom.

DETAILED DESCRIPTION

In view of the above discussion, and in view of other considerations relating to design and operation of marine vessels, it is desirable to have a marine vessel control system which can provide forces in a plurality of directions, such as a trimming force, and which can control thrust forces in a safe and efficient manner. Some aspects of the present invention generate or transfer force from a waterjet stream, initially flowing in a first direction, into one or more alternate directions. Other aspects provide controls for such systems.

Aspects of marine vessel propulsion, including trim control, are described further in pending U.S. patent application, Ser. No. 10/213,829, which is hereby incorporated by reference in its entirety. In addition, some or all aspects of the present invention apply to systems using equivalent or similar components and arrangements, such as outboard motors instead of jet propulsion systems and systems using various prime movers not specifically disclosed herein.

Figure 1:
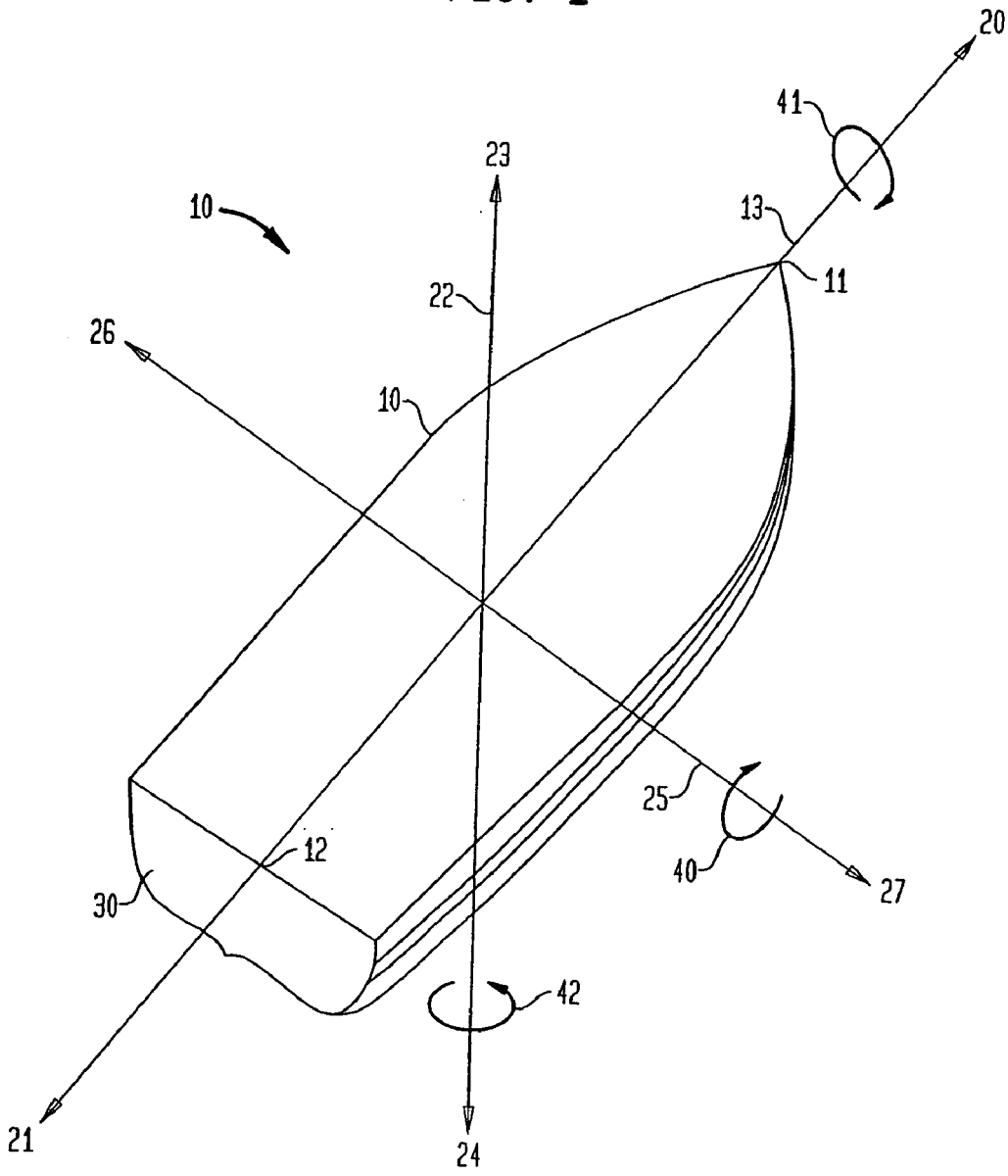
FIG. 1 illustrates an outline of a marine vessel and various axes and directions of motion referenced thereto.

Prior to a detailed discussion of various embodiments of the present invention, it is useful to define certain terms that describe the geometry of a marine vessel and associated propulsion and control systems. FIG. 1 illustrates an exemplary outline of a marine vessel 10 having a forward end called a bow 11 and an aft end called a stern 12. A line connecting the bow 11 and the stern 12 defines an axis hereinafter referred to the marine vessel's major axis 13. A vector along the major axis 13 pointing along a direction from stern 12 to bow 11 is said to be pointing in the ahead or forward direction 20. A vector along the major axis 13 pointing in the opposite direction (180° away) from the ahead direction 20 is said to be pointing in the astern or reverse or backing direction 21.

The axis perpendicular to the marine vessel's major axis 13 and nominally perpendicular to the surface of the water on which the marine vessel rests, is referred to herein as the vertical axis 22. The vector along the vertical axis 22 pointing away from the water and towards the sky defines an up direction 23, while the oppositely-directed vector along the vertical axis 22 pointing from the sky towards the water defines the down direction 24. It is to be appreciated that the axes and directions, e.g. the vertical axis 22 and the up and down directions 23 and 24, described herein are referenced to the marine vessel 10. In operation, the vessel 10 experiences motion relative to the water in which it travels. However, the present axes and directions are not intended to be referenced to Earth or the water surface.

The axis perpendicular to both the marine vessel's major axis 13 and a vertical axis 22 is referred to as an athwartships axis 25. The direction pointing to the left of the marine vessel with respect to the ahead direction is referred to as the port direction 26, while the opposite direction, pointing to the right of the vessel with respect to the forward direction 20 is referred to as the starboard direction 27. The athwartships axis 25 is also sometimes referred to as defining a "side-to-side" force, motion, or displacement. Note that the athwartships axis 25 and the vertical axis 22 are not unique, and that many axes parallel to said athwartships axis 22 and vertical axis 25 can be defined.

With this the three most commonly-referenced axes of a marine vessel have been defined. The marine vessel 10 may be moved forward or backwards along the major axes 13 in directions 20 and 21, respectively. This motion is usually a primary translational motion achieved by use of the vessels propulsion systems when traversing the water as described earlier. Other motions are possible, either by use of vessel control systems or due to external forces such as wind and water currents. Rotational motion of the marine vessel 10 about the athwartships axis 25 which alternately raises and lowers the bow 11 and stern 12 is referred to as pitch 40 of the vessel. Rotation of the marine vessel 10 about its major axis 13, alternately raising and lowering the port and starboard sides of the vessel is referred to as roll 41. Finally, rotation of the marine vessel 10 about the vertical axis 22 is referred to as yaw 42. An overall vertical displacement of the entire vessel 10 that moves the vessel up and down (e.g. due to waves) is called heave.

In waterjet propelled marine vessels a waterjet is typically discharged from the aft end of the vessel in the astern direction 21. The marine vessel 10 normally has a substantially planar bulkhead or portion of the hull at its aft end referred to as the vessel's transom 30. In some small craft an outboard propeller engine is mounted to the transom 30.

Figure 2:
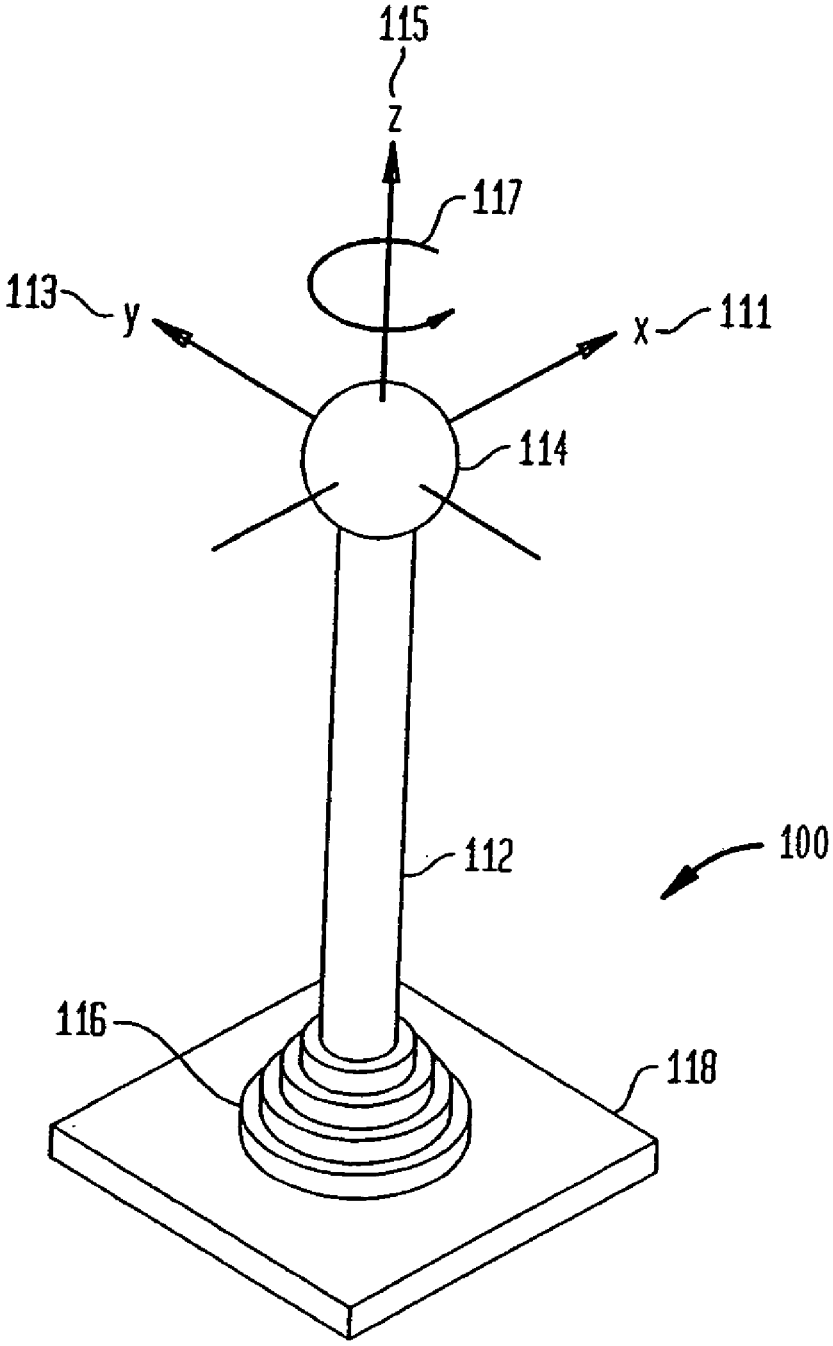
FIG. 2 illustrates an exemplary embodiment of a control stick and associated degrees of freedom.

FIG. 2 illustrates an exemplary vessel control apparatus 100. The vessel control apparatus 100 can take the form of an electro-mechanical control apparatus such as a control stick, sometimes called a joystick. The control stick generally comprises a stalk 112, ending in a handle 114. This arrangement can also be thought of as a control lever. The control stick also has or sits on a support structure 118, and moves about one or more articulated joints 116 that permit one or more degrees of freedom of movement of the control stick. Illustrated are some exemplary degrees of freedom or directions of motion of the vessel control apparatus 100. The "y" direction 113 describes forward-and-aft motion of the vessel control apparatus. The "x" direction 111 describes side-to-side motion of the vessel control apparatus 100. It is also possible in some embodiments to push or pull the handle 114 vertically with respect to the vessel to obtain a vessel control apparatus 100 motion in the "z" direction 115. It is also possible, according to some embodiments, to twist the control stick along a rotary degree of freedom 117 by twisting the handle 114 clockwise or counter-clockwise about the z-axis.

Figure 3:
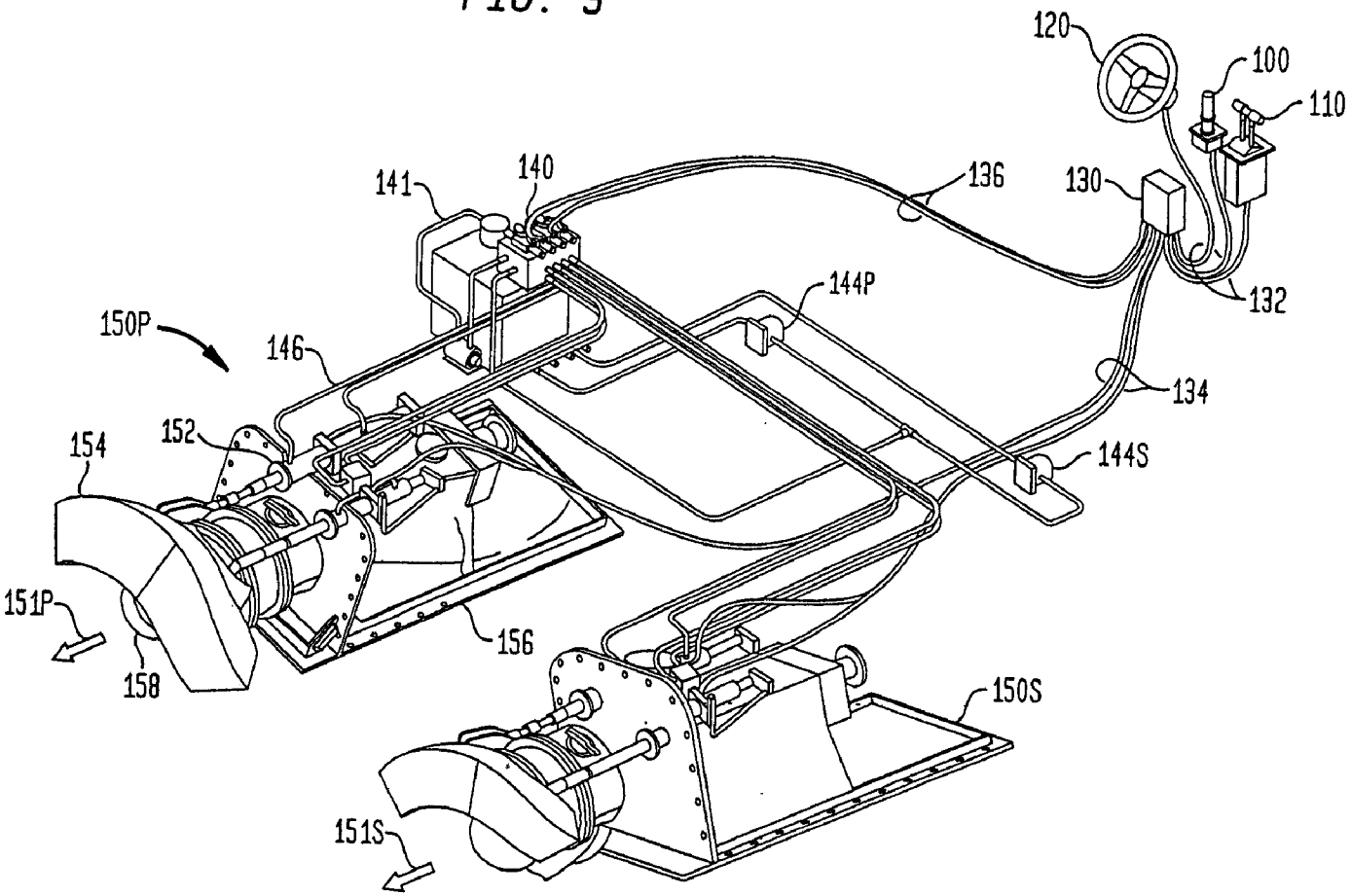
FIG. 3 illustrates an exemplary vessel with a dual waterjet propulsion system and controls therefor.

Referring to FIG. 3, a waterjet propulsion system and control system for a dual waterjet driven marine vessel are illustrated. The figure illustrates a twin jet propulsion system, having a port propulsor or pump 150P and a starboard propulsor 150S that generate respective waterjet streams 151P and 151S. Both the port and starboard devices operate similarly, and will be considered analogous in the following discussions. Propulsor or pump 150 drives waterjet stream 151 from an intake port (not shown, near 156) to nozzle 158. Nozzle 158 may be designed to be fixed or articulated, in which case its motion is typically used to steer the vessel by directing the exit waterjet stream to have a sideways component. The figure also illustrates reversing deflector 154 that is moved by a control actuator 152. The control actuator 152 comprises a hydraulic piston cylinder arrangement for pulling and pushing the reversing deflector 154 into and out of the waterjet stream 151P. The starboard apparatus operates similar to that described with regard to the port apparatus, above.

The overall control system comprises electrical as well as hydraulic circuits that includes a hydraulic unit 141. The hydraulic unit 141 may comprise various components required to sense and deliver hydraulic pressure to various actuators. For example, the hydraulic unit 141 may comprise hydraulic fluid reservoir tanks, filters, valves and coolers. Hydraulic pumps 144P and 144S provide hydraulic fluid pressure and can be fixed or variable-displacement pumps. This aspect allows for a variable actuator rate of movement. Actuator control valve 140 delivers hydraulic fluid to and from the actuators, e.g. 152, to move the actuators. Actuator control valve 140 may be a proportional solenoid valve that moves in proportion to a current or voltage provided to its solenoid to provide variable valve positioning. Return paths are provided for the hydraulic fluid returning from the actuators 152. Hydraulic lines, e.g. 146, provide the supply and return paths for movement of hydraulic fluid in the system. Of course, many configurations and substitutions may be carried out in designing and implementing specific vessel control systems, depending on the application, and that described in regard to the present embodiments is only illustrative.

The operation of the electro-hydraulic vessel control system of FIG. 3 is as follows. A vessel operator moves one or more vessel control apparatus. For example, the operator moves the helm 120, the engine throttle controller 110 or the control stick 100. Movement of said vessel control apparatus is in one or more directions, facilitated by one or more corresponding degrees of freedom. The helm 120, for example, may have a degree of freedom to rotate the wheel in the clockwise direction and in the counter-clockwise direction. The throttle controller 110 may have a degree of freedom to move forward-and-aft, in a linear, sliding motion. The control stick 100 may have two or more degrees of freedom and deflects from a neutral center position as described earlier with respect to FIG. 2.

The movement of one or more of the vessel control apparatus generates an electrical vessel control signal. The vessel control signal is generated in any one of many known ways, such as by translating a mechanical movement of a wheel or lever into a corresponding electrical signal through a potentiometer. Digital techniques as well as analog techniques are available for providing the vessel control signal and are within the scope of this disclosure.

The vessel control signal is delivered to a control processor unit 130 which comprises at least one processor adapted for generating a plurality of actuator control signals from the vessel control signal. The electrical lines 132 are input lines carrying vessel control signals from the respective vessel control apparatus 100, 110 and 120. The control processor unit 130 may also comprise a storage member that stores information using any suitable technology. For example, a data table holding data corresponding to equipment calibration parameters and set points can be stored in a magnetic, electrostatic, optical, or any other type of unit within the control processor unit 130.

Other input signals and output signals of the control processor unit 130 include output lines 136, which carry control signals to control electrically-controlled actuator control valve 140. Also, control processor unit 130 receives input signals on lines 134 from any signals of the control system to indicate a position or status of that part. These input signals may be used as a feedback in some embodiments that enhance the operation of the system or that provides an indication to the operator or another system indicative of the position or status of that part.

Figure 4:
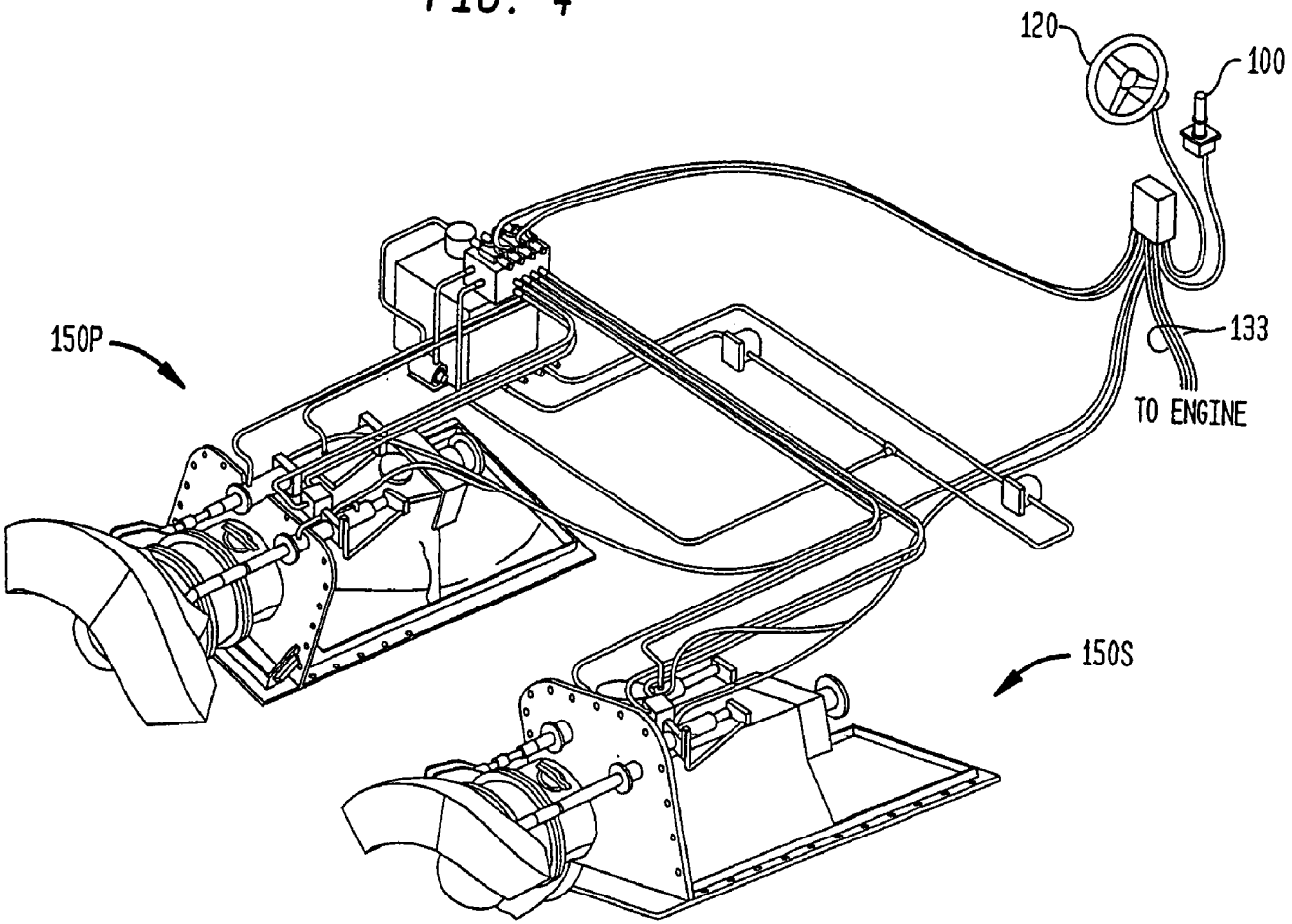
FIG. 4 illustrates another exemplary vessel with a dual waterjet propulsion system and controls therefor.

FIG. 4 illustrates another exemplary embodiment of a dual jet driven propulsion and control system for a marine vessel and is similar to FIG. 3 except that the system is controlled with only a helm 120 and a control stick 100. It is to be appreciated that throughout this description like parts have been labeled with like reference numbers, and a description of each part is not always repeated for the sake of brevity. For this embodiment, the functions of the throttle controller 110 of FIG. 3 are subsumed in the functions of the control stick 100. Outputs 133 "To Engine" allow for control of the pumps 150P and 150S. In some embodiments, the steering nozzles 158 may be controlled from the control stick 100 as well.

Figure 5:
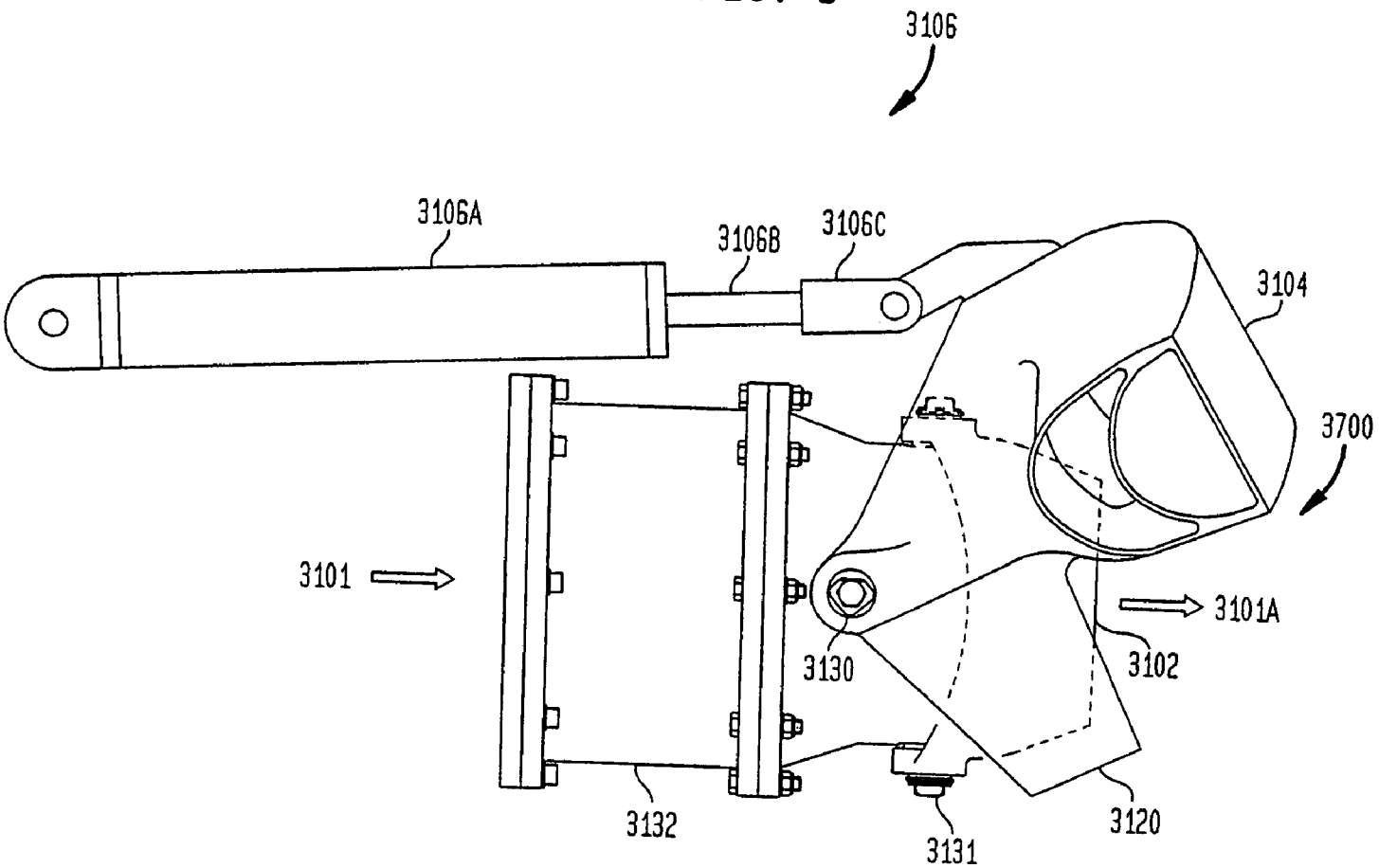
FIG. 5 illustrates an exemplary control apparatus and associated actuator.

FIG. 5 illustrates an example of a control device and associated actuator. A waterjet stream is produced at the outlet of a waterjet pump as described earlier, or is generated using any other water-drive apparatus. A waterjet propulsion system moves a waterjet stream 3101 pumped by a pump (also referred to herein as a propulsor, or a means for propelling water to create the waterjet) through waterjet housing 3132 and out the aft end of the propulsion system through an articulated steering nozzle 3102.

The fact that the steering nozzle 3102 is articulated to move side-to-side will be explained below, but this nozzle 3102 may also be fixed or have another configuration as used in various applications. The waterjet stream exiting the steering nozzle 3102 is designated as 3101A.

FIG. 5 also illustrates a laterally-fixed reversing bucket 3104 and trim deflector 3120 positioned to allow the waterjet stream to flow freely from 3101 to 3101A, thus providing forward thrust for the marine vessel. The forward thrust results from the flow of the water in a direction substantially opposite to the direction of the thrust. Trim deflector 3120 is fixably attached to reversing deflector 3104 in this embodiment, and both the reversing deflector 3104 and the trim deflector 3120 rotate in unison about a pivot 3130.

Other embodiments of a reversing deflector and trim deflector for a waterjet propulsion system are illustrated in commonly-owned, co-pending U.S. patent application Ser. No. 10/213,829, which is hereby incorporated by reference in its entirety.

The apparatus for moving the integral reversing deflector and trim deflector comprises a hydraulic actuator 3106, comprising a hydraulic cylinder 3106A in which travels a piston and a shaft 3106B attached to a pivoting clevis 3106C. Shaft 3106B slides in and out of cylinder 3106A, causing a corresponding raising or lowering of the integral reversing deflector and trim deflector apparatus 3700, respectively.

It can be appreciated from FIG. 5 that progressively lowering the reversing deflector will provide progressively more backing thrust, until the reversing deflector is placed fully in the exit stream 3101A, and full reversing or backing thrust is developed. In this position, trim deflector 3120 is lowered below and out of the exit stream 3101A, and provides no trimming force.

Similarly, if the combined reversing deflector and trim deflector apparatus 3700 is rotated upwards about pivot 3130 (counter clockwise in FIG. 5) then the trim deflector 3120 will progressively enter the exiting water stream 3101A, progressively providing more trimming force. In such a configuration, the reversing deflector 3104 will be raised above and out of waterjet exit stream 3101A, and reversing deflector 3104 will provide no force.

However, it is to be understood that various modifications to the arrangement, shape and geometry, the angle of attachment of the reversing deflector 3104 and the trim deflector 3120 and the size of the reversing deflector 3104 and trim deflector 3120 are possible, as described for example in co-pending U.S. patent application Ser. No. 10/213,829. It is also to be appreciated that although such arrangements are not expressly described herein for all embodiments, but that such modifications are nonetheless intended to be within the scope of this disclosure.

Steering nozzle 3102 is illustrated in FIG. 5 to be capable of pivoting about a trunion or a set of pivots 3131 using a hydraulic actuator. Steering nozzle 3102 may be articulated in such a manner as to provide side-to-side force by rotating the steering nozzle 3102, thereby developing the corresponding sideways force that steers the marine vessel. This mechanism works even when the reversing deflector 3104 is filly deployed, as the deflected water flow will travel through the port and/or starboard sides of the reversing deflector 3104. Additionally, the steering nozzle 3102 can deflect side-to-side when the trim deflector 3120 is fully deployed.

Figure 6:
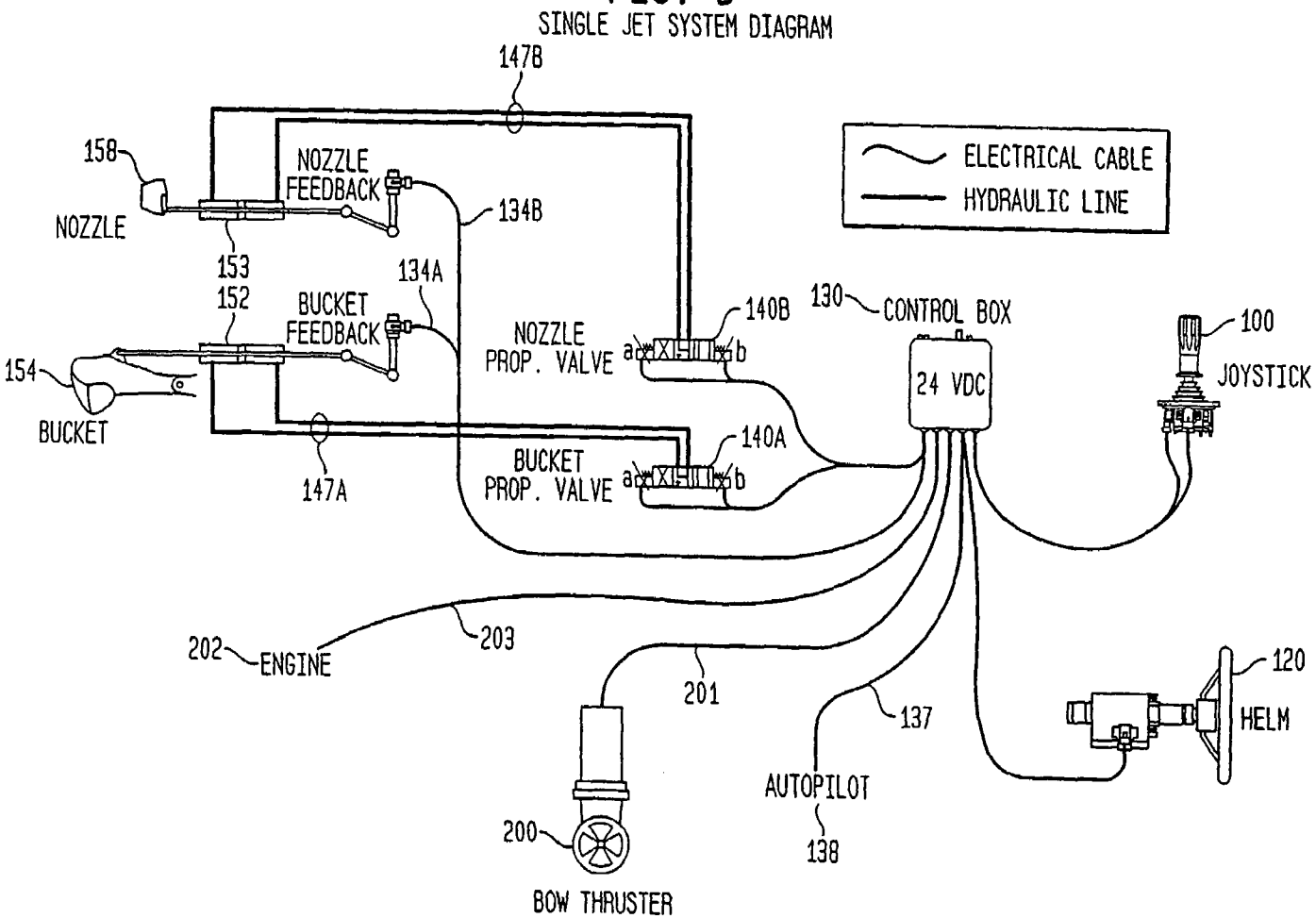
FIG. 6 illustrates an exemplary control system (cabling) diagram for a single waterjet propulsion system.

FIG. 6 illustrates an exemplary control system diagram for a single waterjet driven marine vessel having one associated steering nozzle and one associated reversing bucket as well as a bow thruster 200. The diagram illustrates a vessel control stick 100 (joystick) and a helm 120 connected to provide vessel control signals to a 24 volts DC control processor unit 130 (control box). The vessel control unit 130 provides actuator control signals to a number of devices and actuators and receives feedback and sensor signals from a number of actuators and devices. The figure only illustrates a few such actuators and devices, with the understanding that complete control of a marine vessel is a complex procedure that can involve any number of control apparatus (not illustrated) and depends on a number of operating conditions and design factors. Note that the figure is an exemplary cabling diagram, and as such, some lines are shown joined to indicate that they share a common cable, in this embodiment, and not to indicate that they are branched or carry the same signals.

One output signal of the control processor unit 130 is provided, on line 141A, to a reversing bucket proportional solenoid valve 140A. The bucket proportional solenoid valve 140A has coils, indicated by "a" and "b" that control the hydraulic valve ports to move fluid through hydraulic lines 147A to and from reversing bucket actuator 152. The reversing bucket actuator 152 can retract or extend to move the reversing bucket 154 up or down to appropriately redirect the waterjet stream and provide forward or reversing thrust.

Another output of the control processor unit 130, on line 141B, is provided to the nozzle proportional valve 140B. The nozzle proportional valve 140B has coils, indicated by "a" and "b" that control the hydraulic valve ports to move fluid through hydraulic lines 147B to and from nozzle actuator 153. The nozzle actuator 153 can retract or extend to move the nozzle 158 from side to side control the waterjet stream and provide a turning force.

Additionally, an output on line 203 of the control processor unit 130 provides an actuator control signal to control a prime mover, or engine 202. As stated earlier, an actuator may be any device or element able to actuate or set an actuated device. Here the engine's rotation speed (RPM) or another aspect of engine power or throughput may be so controlled using a throttle device, which may comprise any of a mechanical, e.g. hydraulic, pneumatic, or electrical device, or combinations thereof.

Also, a bow thruster 200 (sometimes referred to merely as a "thruster") is controlled by actuator control signal provided on output line 201 by the control processor unit 130. The actuator control signal on line 201 is provided to a bow thruster actuator to control the bow thruster 200. Again, the bow thruster actuator may be of any suitable form to translate the actuator control signal on line 201 into a corresponding movement or action or state of the bow thruster 200. Examples of thruster actions include speed of rotation of an impeller and/or direction of rotation of the impeller.

According to an aspect of some embodiments of the control system, an autopilot 138, as known to those skilled in the art, can provide a vessel control signal 137 to the control processor unit 130, which can be used to determine actuator control signals. For example, the autopilot 138 can be used to maintain a heading or a speed. It is to be appreciated that the autopilot 138 can also be integrated with the control processor unit 130 and that the control processor unit 130 can also be programmed to comprise the autopilot 138.

Figure 7:
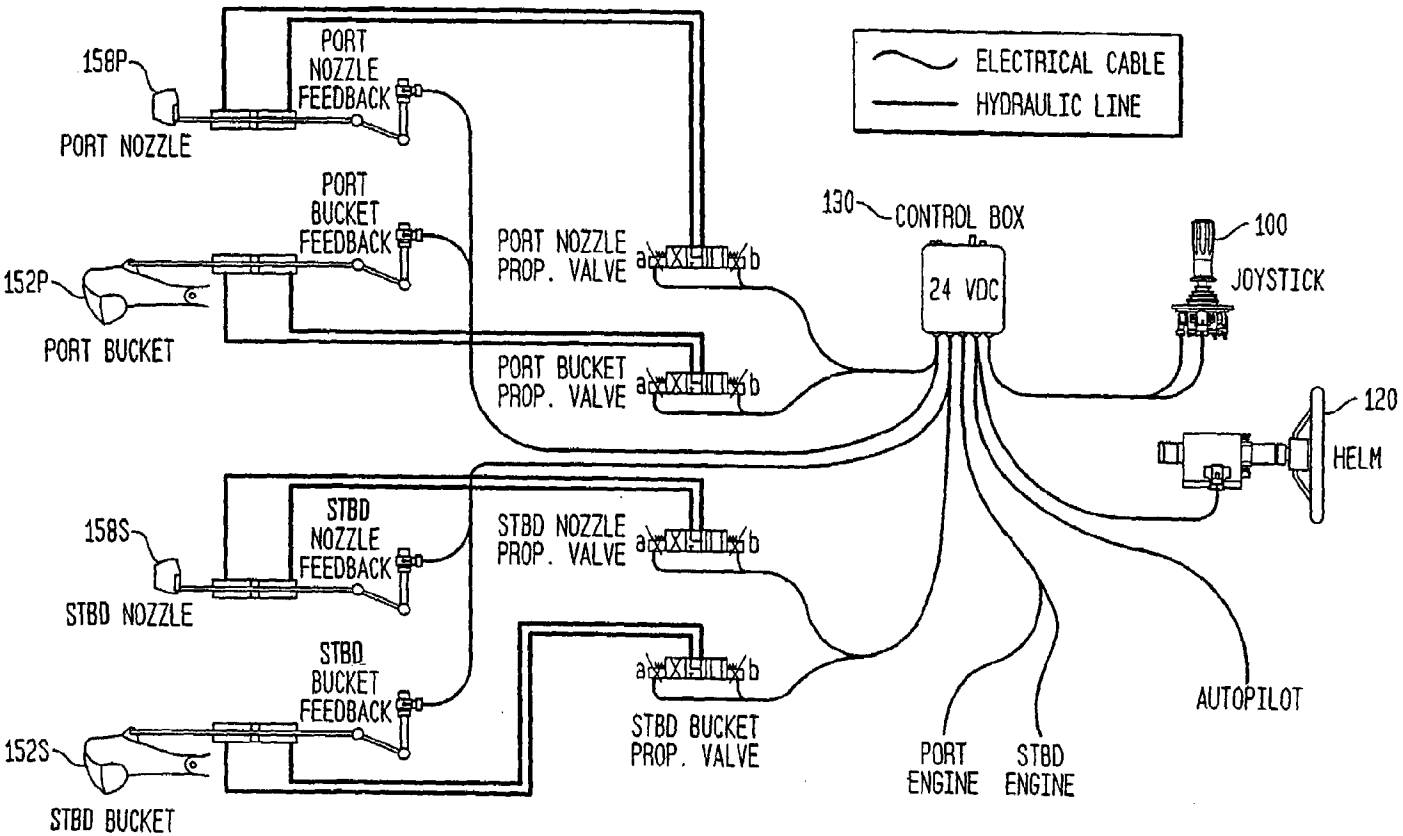
FIG. 7 illustrates an exemplary control system (cabling) diagram for a dual waterjet propulsion system.

FIG. 7 illustrates a control system for a marine vessel having two waterjets, two nozzles, 158P and 158S, and two reversing buckets, 152P and 152S. The operation of this system is substantially the same as that of FIG. 6, and like parts have been illustrated with like reference numbers and a description of such parts is omitted for the sake of brevity. However, this embodiment of the control processor unit 130 generates more output actuator control signals based on the input vessel control signals received from vessel control apparatus 100 and 120. Specifically, the operation of a vessel having two or more waterjets, nozzles, reversing buckets, etc. use a different set of algorithms, for example, stored within control processor unit 130, for calculating or generating the output actuator control signals provided by the control processor unit 130. Such algorithms can take into account the design of the vessel, and the number and arrangement of the control surfaces and propulsion apparatus.

Figure 8:
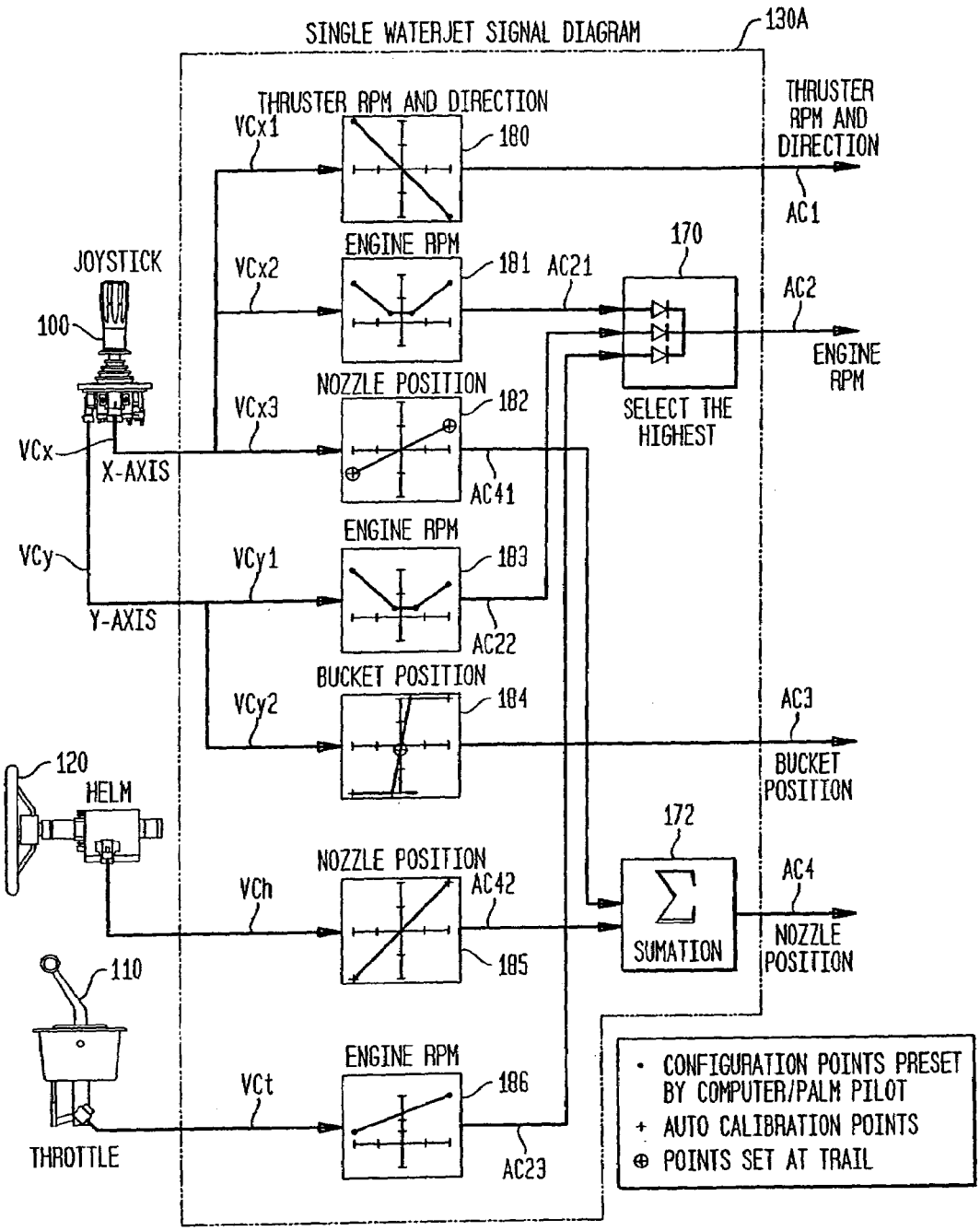
FIG. 8 illustrates an exemplary control processor unit and exemplary set of signals.

We now look at a more detailed view of the nature of the signals provided to and produced by the control processor unit 130. FIG. 8 illustrates a portion of a control processor unit 130A with a dashed outline, symbolically representing an exemplary set of signals and functions processed and provided by the control processor unit 130 for a marine vessel having a single waterjet propulsor apparatus. As described earlier, the control processor unit receives one or more input signals from one or more vessel control apparatus, e.g., 100, 110, and 120.

Control stick 100 is a joystick-type vessel control apparatus, having two degrees of freedom (x and y) which provide corresponding output vessel control signals VCx and VCy. Each of the vessel control signals VCx and VCy can be split into more than one branch, e.g. VCx1, VCx2 and VCx3, depending on how many functions are to be carried out and how many actuators are to be controlled with each of the vessel control signals VCx and VCy.

The helm 120 is a vessel control apparatus and has one degree of freedom and produces a vessel control signal VCh corresponding to motion of the helm wheel along a rotary degree of freedom (clockwise or counter-clockwise).

Throttle control 110 is a vessel control apparatus and has one degree of freedom and produces a vessel control signal VCt corresponding to motion of the throttle control 110 along a linear degree of freedom.

According to one aspect of the invention, each vessel control signal is provided to the control processor unit 130 and is used to produce at least one corresponding actuator control signal. Sometimes more than one vessel control signal are processed by control processor unit 130 to produce an actuator control signal.

According to the embodiment illustrated in FIG. 8, the x-axis vessel control signal VCx provided by the control stick 100 is split to control three separate device actuators: a bow thruster actuator, a prime mover engine RPM actuator and a waterjet nozzle position actuator (devices and actuators not shown). The vessel control signal VCx is split into three vessel control branch signals, VCx1, VCx2 and VCx3. The branch signals can be thought of as actually splitting up by a common connection from the main vessel control signal VCx or derived in some other way that allows the vessel control signal VCx to be used three times. Vessel control branch signal VCx1 is equal to the vessel control signal VCx and is input to a bow thruster RPM and direction module 180 that is adapted for calculating actuator signal AC1 to control the RPM and direction of motion of the bow thruster. In one embodiment of the bow thruster RPM and direction module 180, processor module 130A is provided with a look-up table (LUT) which determines the end-points of the functional relationship between the input vessel control branch signal VCx1 and the output actuator control signal AC1.

Processor module 130A may be one of several processing modules that comprise the control processor unit 130. Many other functions, such as incorporation of a feedback signal from one or more actuators can be performed by the processors 130, 130A as well. The signals shown to exit the processor module 130A are only illustrative and may be included with other signals to be processed in some way prior to delivery to an actuator. Note that in some embodiments of the processor module 130A there is no difference, or substantially no difference, between the vessel control signal VCx and the associated vessel control branch signals (e.g., VCx1, VCx2 and VCx3), and they will all be generally referred to herein as vessel control signals. One of skill in the art would envision that the exact signals input into the function modules of a control processor unit can be taken directly from the corresponding vessel control apparatus, or could be pre-processed in some way, for example by scaling through an amplifier or by converting to or from any of a digital signal and an analog signal using a digital-to-analog or an analog-to-digital converter.

While various embodiments described herein present particular implementations of the control processor unit 130 and the various associated modules which functionally convert input vessel control signals to actuator control signal outputs, it should be understood that the invention is not limited to these illustrative embodiments. For example, the modules and control processor unit 130 may be implemented as a processor comprising semiconductor hardware logic which executes stored software instructions. Also, the processor and modules may be implemented in specialty (application specific) integrated circuits ASICs, which may be constructed on a semiconductor chip. Furthermore, these systems may be implemented in hardware and/or software which carries out a programmed set of instructions as known to those skilled in the art.

The waterjet prime mover (engine) RPM is controlled in the following way. Vessel control branch signal VCx2, which is substantially equal to the vessel control signal VCx is provided to engine RPM module 181 that is adapted for calculating a signal AC21. In addition, vessel control signal VCy is used to obtain vessel control branch signal VCy1 that is provided to engine RPM module 183, which determines and provides an output signal AC22. Further, throttle control apparatus 110, provides vessel control signal VCt, that is provided to engine RPM module 186 that determines and provides an output signal AC23. The three signals AC21, AC22 and AC23 are provided to a selector 170 that selects the highest of the three signals. The highest of AC21, AC22 and AC23 is provided as the actuator control signal AC2 that controls the engine RPM. It is to be appreciated that, although engine RPM modules 181, 183 and 186 have been illustrated as separate modules, they can be implemented as one module programmed to perform all three functions, such as a processor programmed according to the three illustrated functions.

It should also be pointed out that the system described above is only exemplary. Other techniques for selecting or calculating actuator control signal AC2 are possible. For example, it is also possible to determine averages or weighted averages of input signals, or use other or additional input signals, such as feedback signals to produce AC2. It is also to be appreciated that, depending on the desired vessel dynamics and vessel design, other function modules and selectors may be implemented within control processor unit 130 as well.

As mentioned above, control stick 100 produces vessel control signal VCy when the control stick 100 is moved along the y-direction degree of freedom as previously mentioned. According to another aspect of this embodiment, reversing bucket position module 184 receives vessel control signal VCy and calculates the actuator control signal AC3. The signal AC3 is provided to the reversing bucket actuator (not shown). Signal AC3 may be an input to a closed-loop position control circuit wherein signal AC3 corresponds to a position of the reversing bucket actuator, provided directly or indirectly, to cause the reversing bucket to be raised and lowered, as described earlier. Reference is made to FIG. 6, in which signals 134A and 134B are feedback signals from the reversing bucket actuator 152 and the nozzle actuator 153, respectively. More detailed descriptions of the construction and operation of closed-loop feedback circuits in marine vessel control systems are provided in the patent applications referenced earlier in this section, which are hereby incorporated by reference.

According to another aspect of the invention, input signals are taken from each of the control stick 100 and the helm 120 to operate and control the position of the waterjet nozzle (not shown). Vessel control signals VCx3 and VCh are provided to nozzle position modules 182 and 186, which generate signals AC41 and AC42 respectively. The signals AC41 and AC42 are summed in a summing module 172 to produce the nozzle position actuator control signal AC4. Note that the summing module 172 can be replaced with an equivalent or other function, depending on the application.

The previous discussion has illustrated that algorithms can be implemented within the control processor unit 130, and are in some embodiments carried out using function modules. This description is conceptual and should be interpreted generally, as those skilled in the art recognize the possibility of implementing such a processing unit in a number of ways. These include implementation using a digital microprocessor that receives the input vessel control signals or vessel control branch signals and performs a calculation using the vessel control signals to produce the corresponding output signals or actuator control signals. Also, analog computers may be used which comprise circuit elements arranged to produce the desired outputs. Furthermore, look-up tables containing any or all of the relevant data points may be stored in any fashion to provide the desired output corresponding to an input signal.

Key data points on the plots of the various functions relating the inputs and outputs of the function modules are indicated with various symbols, e.g. solid circles, plus signs and circles containing plus signs. These represent different modes of calibration and setting up of the functions and will be explained below.

Figure 9A:
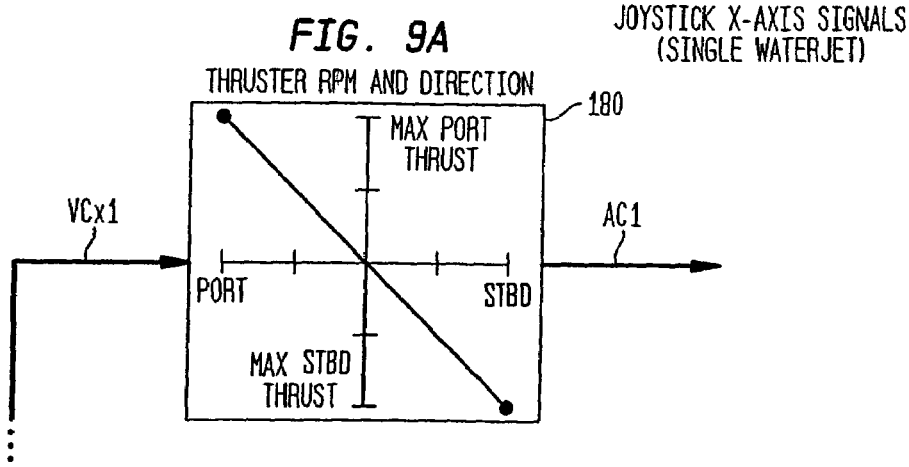
FIG. 9 illustrates an exemplary set of control functions and signals for a single waterjet vessel corresponding to motion of a control stick in the x-direction.
Figure 9B:
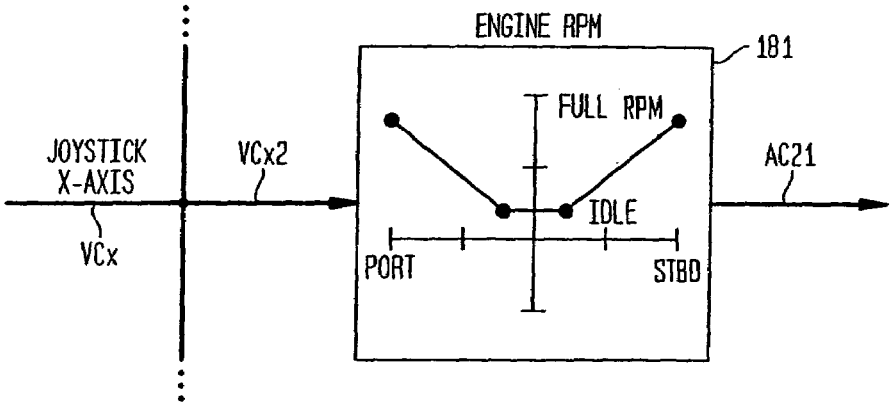
Figure 9C:
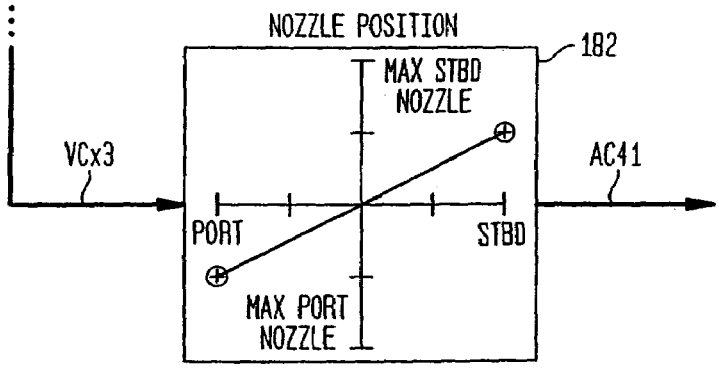
Figure 10A:
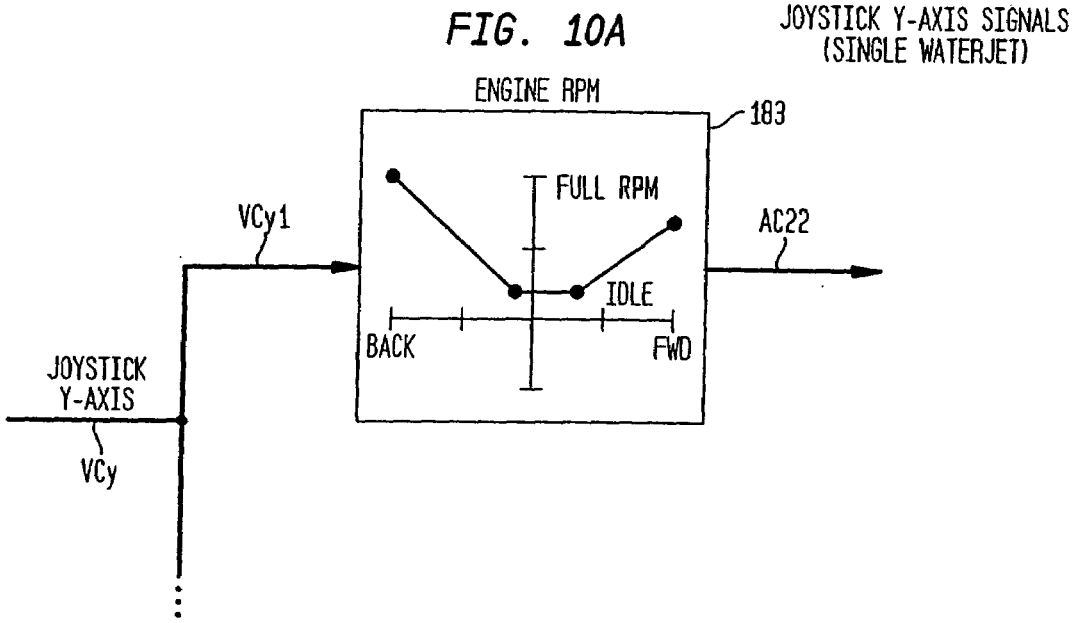
FIG. 10 illustrates an exemplary set of control functions and signals for a single waterjet vessel corresponding to motion of a control stick in the y-direction.
Figure 10B:
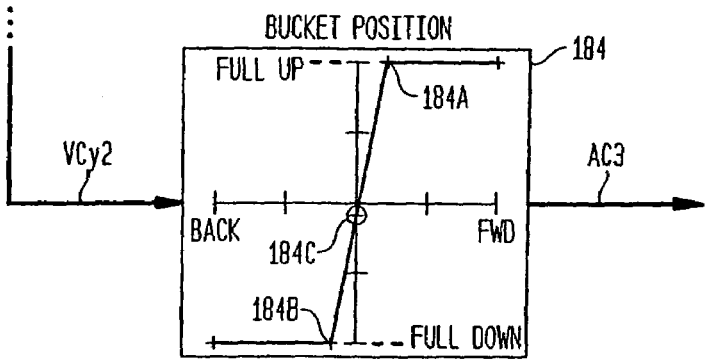
Figure 11A:
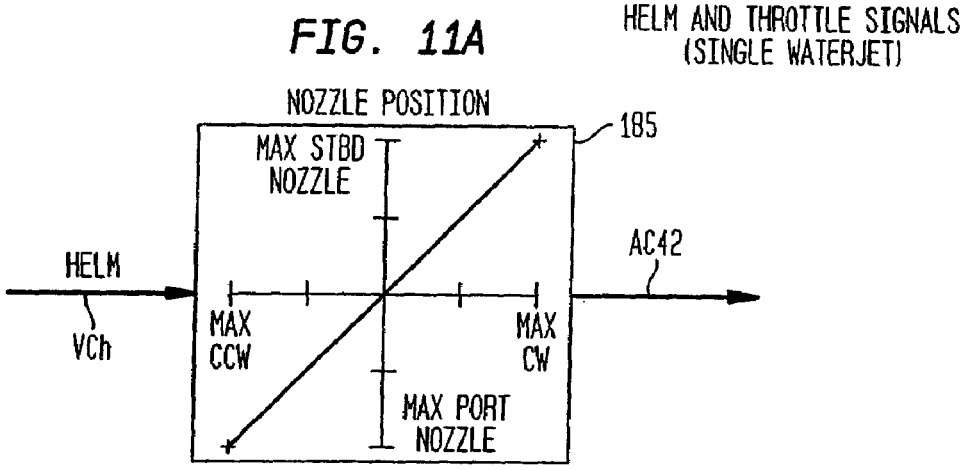
FIG. 11 illustrates an exemplary set of control functions and signals for a single waterjet vessel corresponding to motion of a throttle and helm control apparatus.
Figure 11B:
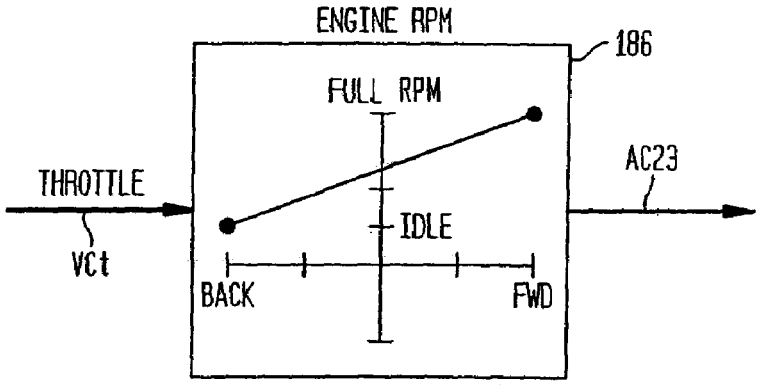

Specific examples of the algorithms for generating the previously-described actuator control signals for single-waterjet vessels are given in FIGS. 9–11.

FIG. 9(*a*) illustrates the bow thruster RPM and direction module 180, the engine RPM module 181, and the nozzle position module 182 in further detail. Each of these modules receives as an input signals due to motion of the control stick 100 along the x-direction or x-axis. As mentioned before, such motion generates a vessel control signal VCx that is split into three signals VCx1, VCx2 and VCx3. The thruster RPM and direction of thrust module 180 converts vessel control branch signal VCx1 into a corresponding actuator control signal AC1. According to one embodiment of the invention, module 180 provides a linear relationship between the input VCx1 and the output AC1. The horizontal axis shows the value of VCx1 with a neutral (zero) position at the center with port being to the left of center and starboard ("STBD") being to the right of center in the figure. An operator moving the control stick 100 to port will cause an output to generate a control signal to drive the bow thruster in a to-port direction. The amount of thrust generated by the bow thruster 200 (see FIG. 6) is dictated in part by the bow thruster actuator and is according to the magnitude of the actuator control signal AC1 along the y-axis in module 180. Thus, when no deflection of the control stick 100 is provided, zero thrust is generated by the bow thruster 200. Operation to-starboard is analogous to that described above in regard to the to-port movement.

It is to be appreciated that the bow thruster 200 can be implemented in a number of ways. The bow thruster 200 can be of variable speed and direction or can be of constant speed and variable direction. The bow thruster 200 may also be an electrically-driven propulsor whose speed and direction of rotation are controlled by a signal which is proportional to or equal to actuator control signal AC1. The precise form of this function is determined by preset configuration points typically set at the factory FIG. 9(*b*) illustrates the relationship between waterjet prime mover engine RPM and the vessel control signal VCx2, according to one embodiment of the invention. Engine RPM module 181 receives vessel control signal (or branch signal) VCx2 and uses a group of preset data points relating the vessel control signal inputs to actuator control signal outputs to compute a response. Simply put, for control stick 100 movements near the neutral x=0 center position, engine RPM control module provides an engine RPM control signal having an amplitude that is minimal, and consists of approximately idling the engine at its minimal value. According to an aspect of this embodiment, this may be true for some interval of the range of the control stick 100 in the x-direction about the center position as shown in the figure, or may be only true for a point at or near the center position.

The figure also shows that, according to this embodiment of the module 181, moving the control stick 100 to its full port or full starboard position generates the respective relative maximum engine RPM actuator control signal AC21. While the figure shows the port and starboard signals as symmetrical, they may be asymmetrical to some extent if dictated by some design or operational constraint that so makes the vessel or its auxiliary equipment or load asymmetrical with respect to the x-axis. The precise form of this function is determined by preset configuration points typically set at the factory or upon installation.

FIG. 9(*c*) illustrates the relation between the vessel control signal VCx3 and the discharge nozzle position according to one embodiment of the invention. Nozzle position module 182 generates an output actuator control signal AC41 based on the x-axis position of the control stick 100. The nozzle actuator (not shown) moves the nozzle in the port direction in proportion to an amount of deflection of the control stick 100 along the x-axis in the port direction and moves the nozzle in the starboard direction in proportion to an amount of deflection of the control stick 100 along the x-axis in the starboard direction. The precise function and fixed points therein are calibrated based on an optimum settings procedure and may be performed dock-side by the operator or underway, as will be described in more detail below.

FIGS. 10(*a, b*) illustrate the engine RPM module 183 and the bucket position module 184 in further detail. Each of these modules receives an input signal VCy taken from the control stick 100 when moved along the y-direction. FIG. 10(*a*) illustrates a vessel control branch signal VCy1 which is provided to engine RPM module 183, which in turn computes an output signal AC22. Said output signal AC22 provides a control signal AC2 to the waterjet engine RPM actuator (not shown). Signal AC22 is combined with other signals, as discussed earlier, to provide the actual actuator control signal AC2. According to this embodiment of the engine RPM module, the engine RPM is set to a low (idle) speed at or around the y=0 control stick position. Also, the extreme y-positions of the control stick result in relative maxima of the engine RPM. It should be pointed out that in this embodiment this function is not symmetrical about the y=0 position, due to a loss of efficiency with the reversing bucket deployed, and depends upon calibration of the system at the factory.

FIG. 10(*b*) illustrates the effect of control stick 100 movement along the y-axis on the reversing bucket position, according to one embodiment of the invention. A vessel control signal VCy2 is plotted on the horizontal axis depicting module 184. When moved to the "back" or aft position, actuator control signal AC3, provided by module 184, causes a full-down movement of the reversing bucket 154 (not shown), thus providing reversing thrust. When the control stick 100 is moved fully forward in the y-direction, actuator control signal AC3 causes a full-up movement of the reversing bucket 154. According to this embodiment, the reversing bucket 154 reaches its maximum up or down positions prior to reaching the full extreme range of motion in the y-direction of the control stick 100. These "shoulder points" are indicated for the up and down positions by numerals 184A and 184B, respectively. The piecewise linear range between points 184A and 184B approximately coincide with the idle RPM range of module 183. This allows for fine thrust adjustments around the neutral bucket position while higher thrust values in the ahead and astern directions are achieved by increasing the engine RPM when the control stick is moved outside of the shoulder points. It can be seen that in this and other exemplary embodiments the center y-axis position of control stick 100 is not necessarily associated with a zero or neutral reversing bucket position. In the case of the embodiment illustrated in FIG. 10(*b*), the zero y-axis position corresponds to a slightly down position 184C of the reversing bucket 154.

FIG. 11(*a*) illustrates the nozzle position function module 185 in further detail. This module receives an input from the vessel control signal VCh and provides as output the actuator control signal AC42. Nozzle position function module 185 determines output signal AC42 to be used in the control of the waterjet discharge nozzle 158 (not shown). The signal AC42 can be used as one of several components that are used to determine actuator control signal AC4, or, in some embodiments, can be used itself as the actuator control signal AC4. This embodiment of the nozzle position function module 185 has a linear relationship between the input signal VCh, received from the helm 120, and the output signal AC42, which can be determined by underway or dock-side auto calibration to select the end points of the linear function. Intermediate values can be computed using known functional relationships for lines or by interpolation from the two end points. Other embodiments are also possible and will be clear to those skilled in the art.

FIG. 11(*b*) illustrates the engine RPM function module 186 in further detail. The figure also illustrates the relationship between the throttle controller signal VCt and the engine RPM actuator signal AC23. As before, a vessel control signal VCt is taken from the vessel control apparatus (throttle controller) 110. The function module 186 converts the input signal VCt into an output signal AC23 which is used to determine the engine RPM actuator control signal AC2. In some embodiments, the throttle controller 110 has a full back position, which sends a signal to the engine RPM actuator to merely idle the engine at its lowest speed. At the other extreme, when the throttle controller 110 is in the full-ahead position, the engine RPM function module 186 provides a signal to the engine RPM actuator, which is instructed to deliver maximum engine revolutions. Note that according to one embodiment of the invention, the exact points on this curve are calibrated at the factory and are used in conjunction with other vessel control inputs to determine the final control signal that is sent to the engine RPM actuator AC2, as shown in FIG. 8.

In some embodiments, key points used in the plurality of functional modules are either pre-programmed at manufacture, or are selected and stored based on a dock-side or underway calibration procedure. In other embodiments, the key points may be used as parameters in computing the functional relationships, e.g. using polynomials with coefficients, or are the end-points of a line segment which are used to interpolate and determine the appropriate function output.

Figure 12:
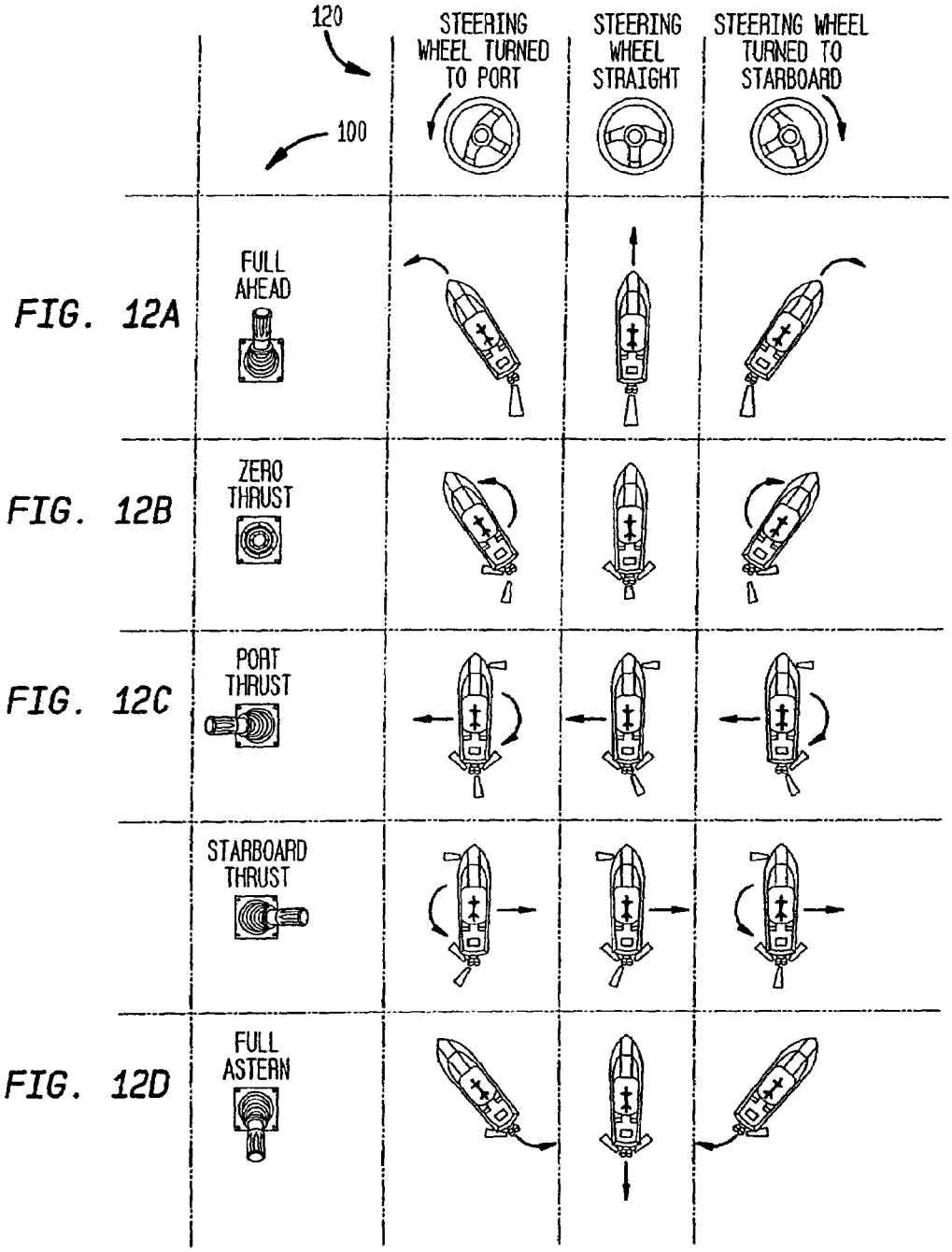
FIG. 12 illustrates exemplary maneuvers provided by motion of a control stick and helm for a single waterjet vessel.

According to this embodiment of the control system, single waterjet vessel control is provided, as illustrated in FIG. 12. By way of example, three exemplary motions of the helm 120, and five exemplary motions of the control stick 100 are shown. The control stick 100 has two degrees of freedom (x and y). It is to be appreciated that numerous other helm 120 and control stick 100 positions are possible but are not illustrated for the sake of brevity. The figure shows the helm in the turn-to-port, in the ahead (no turning) and in the turn-to-starboard positions in the respective columns of the figure. The helm 120 can of course be turned to other positions than those shown.

FIG. 12(*a*) illustrates that if the control stick 100 is placed in the full ahead position and the helm 120 is turned to port then the vessel will turn to port. Because the control stick is in the +y position, and not moved along the x-direction, the bow thruster 200 is off (see FIG. 9(*a*)), the engine RPM is high (see FIG. 10(*a*), heavy waterjet flow is shown aft of vessel in FIG. 12(*a*)) and the reversing bucket is raised (see FIG. 10(*b*)). Engine RPM is high because the highest signal is selected by selector module 170. Because the helm is in the turn-to-port position (counter-clockwise) the steering nozzle 158 is in the turn-to-port direction (see FIG. 11(*a*)). It is to be appreciated that no separate throttle controller 110 is used or needed in this example. As illustrated in FIG. 12(*a*), the vessel moves along a curved path with some turning radius, as the helm control is turned.

Similarly, according to some control maneuvers, by placing the helm 120 in the straight ahead position while the control stick 100 is in the full ahead position, the vessel moves ahead in a straight line at high engine RPM with the reversing bucket 154 raised and the nozzle in the centered position. Helm 120 motion to starboard is also illustrated and is analogous to that as its motion to port and will not be described for the sake of brevity.

FIG. 12(*b*) illustrates operation of the vessel when the control stick 100 is placed in a neutral center position. When the helm 120 is turned to port, the steering nozzle 158 is in the turn-to-port position (see FIG. 11(*a*)) and the engine 200 is idle because the selector module 170 selects the highest RPM signal, which will be according to signal AC21 provided from engine RPM function module 181 (see FIG. 9(*b*) where no throttle is applied). The reversing bucket 154 is approximately in a neutral position that allows some forward thrust and reverses some of the waterjet stream to provide some reversing thrust. (see FIG. 10(*b*)). This reversing flow is deflected by the reversing bucket 154 to the left. The vessel substantially rotates about a vertical axis while experiencing little or no lateral or ahead/astern translation.

According to some maneuvers, by placing the helm 120 in the straight ahead position no motion of the vessel results. That is, no turning occurs, and the forward and backing thrusts are balanced by having the engine at low RPM and the reversing bucket 154 substantially in a neutral position. The reversed waterjet portion is split between the left and the right directions and results in no net force athwartships. Thus, no vessel movement occurs. Helm 120 motion to starboard is also illustrated and is analogous to that of port motion and is not described for the sake of brevity.

FIG. 12(*c*) illustrates vessel movement when the control stick 100 is moved to port. With the helm 120 in a counter-clockwise (port) position, the bow thruster 200 provides thrust to port (see FIG. 9(*a*)), the steering nozzle 158 is in the turn-to-port position (see FIG. 9(*c*)) and the engine RPM is at a high speed (see FIG. 9(*b*)). Again, the precise actuator control signals depend on the function modules, such as summing module 172, which sums signals from function modules 182 and 185. With the reversing bucket sending slightly more flow to the right than to the left, the vessel translates to the left and also rotates about a vertical axis.

The engine RPM is high because selector module 170 selects the highest of three signals Similarly, the helm 120 can be placed in the straight ahead position, which results in the nozzle being to the right and the reversing bucket 154 in a middle (neutral) position. The bow thruster 200 also thrusts to port (by ejecting water to starboard). The net lateral thrust developed by the bow thruster 200 and that developed laterally by the waterjet are equal, so that the vessel translates purely to the left without turning about a vertical axis.

FIG. 12 also illustrates vessel movement with the control stick 100 moved to starboard for three positions of the helm 120. The resultant vessel movement is analogous to that movement described for motion in the port direction and is not herein described for the sake of brevity.

FIG. 12(*d*) illustrates vessel movement when the control stick 100 is placed in the backing (−y) direction. When the helm 120 is turned to port, the bow thruster 200 is off (x=0, see FIG. 9(*a*)), the engine RPM is high (see FIG. 10(*a*)—the highest signal is selected by selector 170), the reversing bucket 154 is in the full down position (see FIG. 10(*b*)) and deflects the flow to the left, and the nozzle is in the turn-to-port position (see FIG. 11(*a*)). The vessel moves in a curved trajectory backwards and to the right.

Similarly, according to some control modules, by placing the helm 120 in the straight ahead position, the reversing bucket 154 remains fully lowered but the nozzle is in the neutral position, so the reversing bucket deflects equal amounts of water to the right and to the left because the nozzle is centered. The bow thruster 200 remains off. Thus, the vessel moves straight back without turning or rotating. Helm 120 motion to starboard is also illustrated and is analogous to that for motion to port and thus will not be described herein.

It should be appreciated that the above examples of vessel movement are "compound movements" that in many cases use the cooperative movement of more than one device (e.g., propulsors, nozzles, thrusters, deflectors, reversing buckets) of different types. It is clear, e.g. from FIGS. 12(*c, d*) that, even if only one single vessel control signal is provided (e.g., −y) of the control stick 100 along a degree of freedom of the control stick 100, a plurality of affiliated actuator control signals are generated by the control system and give the vessel its overall movement response. This is true even without movement of the helm 120 from its neutral position.

It should also be appreciated that in some embodiments the overall movement of the vessel is in close and intuitive correspondence to the movement of the vessel control apparatus that causes the vessel movement. Some embodiments of the present invention can be especially useful in maneuvers like docking.

It should be further appreciated that the algorithms, examples of which were given above for the vessel having a single waterjet propulsor, can be modified to achieve specific final results. Also, the algorithms can use key model points from which the response of the function modules can be calculated. These key model points may be pre-assigned and pre-programmed into a memory on the control processor unit 130 or may be collected from actual use or by performing dock-side or underway calibration tests, as will be described below.

As mentioned previously and as illustrated, e.g., in FIG. 3, a marine vessel may have two or more waterjet propulsors, e.g. 150P. A common configuration is to have a pair of two waterjet propulsors, each having its own prime mover, pump and steering nozzle, e.g., 158. A reversing bucket, e.g. 154, is coupled to each propulsor 150P as well, and the reversing buckets, e.g. 154, may be of a type fixed to the steering nozzle and rotating therewith (not true for the embodiment of FIG. 3), or they may be fixed to a waterjet housing or other part that does not rotate with the steering nozzles 158 (as in the embodiment of FIG. 3).

The following description is for marine vessels having two propulsors, and can be generalized to more than two propulsors, including configurations that have different types of propulsors, such as variable-pitch propellers or other waterjet drives.

Figure 13:
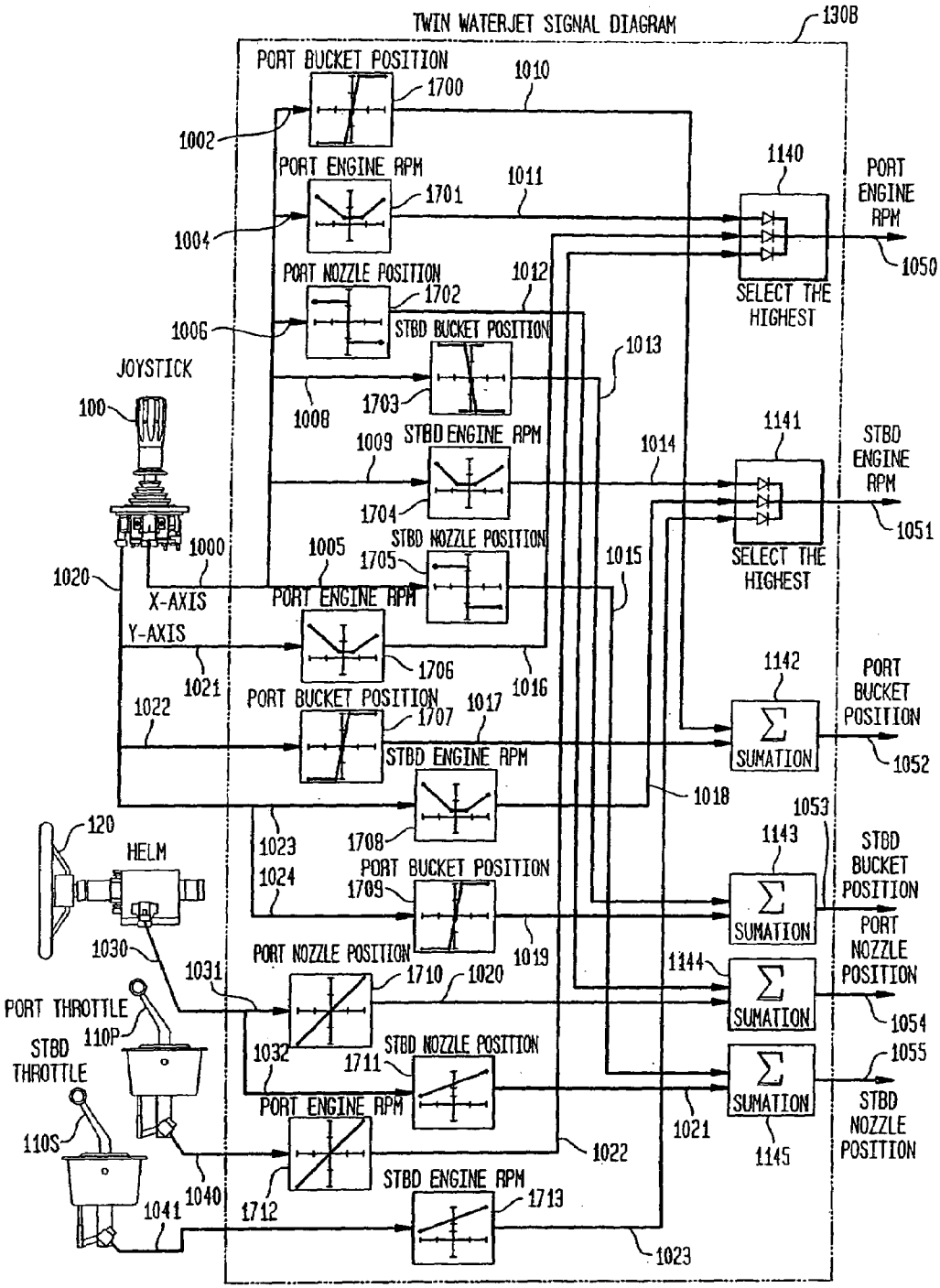
FIG. 13 illustrates an exemplary marine vessel control system signal diagram for a single waterjet vessel.

FIG. 13 illustrates a signal diagram for an exemplary vessel control system controlling a set of two waterjet propulsors and associated nozzles and reversing buckets. This example does not use a bow thruster for maneuvering as in the previous example having only one waterjet propulsor, given in FIG. 8.

Control stick 100 has two degrees of freedom, x and y, and produces two corresponding vessel control signals 1000 and 1020, respectively. The vessel control signals 1000 and 1020 are taken to several function modules through branch signals as discussed earlier with regard to FIG. 8. In the following discussion of FIG. 13 it should be appreciated that more than one vessel control signal can be combined to provide an actuator control signal, in which case the individual vessel control signals may be input to the same function modules or may each be provided to an individual function module. In the figure, and in the following discussion, there is illustrated separate function modules for each vessel control signal, for the sake of clarity. Note that in the event that more than one signal is used to generate an actuator control signal, a post-processing functional module, such as a summer, a selector or an averaging module is used to combine the input signals into an output actuator control signal.

The x-axis vessel control signal 1000 provides an input to each of six function modules: function module 1700, which calculates a signal 1010, used in controlling the port reversing bucket position actuator; function module 1701, which calculates a signal 1011, used in controlling the port engine RPM actuator; function module 1702, which calculates a signal 1012, used in controlling the port nozzle position actuator; function module 1703, which calculates a signal 1013, used in controlling the starboard reversing bucket position actuator; function module 1704, which calculates a signal 1014, used in controlling the starboard engine RPM actuator; and function module 1705, which calculates a signal 1015, used in controlling the starboard nozzle position actuator.

Note that some of the signals output from the function modules are the actuator control signals themselves, while others are used as inputs combined with additional inputs to determine the actual actuator control signals. For example, the port and starboard engine RPM actuators receive a highest input signal from a plurality of input signals provided to selector modules 1140, 1141, as an actuator control signal for that engine RPM actuator.

The y-axis vessel control signal 1020 provides an input to each of four function modules: function module 1706, which calculates a signal 1016, used in controlling the port engine RPM actuator; function module 1707, which calculates a signal 1017, used in controlling the port reversing bucket position actuator; function module 1708, which calculates a signal 1018, used in controlling the starboard engine RPM actuator; and function module 1709, which calculates a signal 1019, used in controlling the starboard reversing bucket position actuator.

Helm vessel control apparatus 120 delivers a vessel control signal to each of two function modules: function module 1710, which calculates a signal 1020, used in controlling the port nozzle position actuator and function module 1711, which calculates a signal 1021, used in controlling the starboard nozzle position actuator.

Two separate throttle control apparatus are provided in the present embodiment. A port throttle controller 110P, which provides a vessel control signal 1040 as an input to function module 1712. Function module 1712 calculates an output signal 1022, based on the vessel control signal 1040, that controls the engine RPM of the port propulsor. Similarly, a starboard throttle controller 110S, provides a vessel control signal 1041 as an input to function module 1713. Function module 1713 calculates an output signal 1023, based on the vessel control signal 1041, that controls the engine RPM of the starboard propulsor.

As mentioned before, more than one intermediate signal from the function modules or elsewhere can be used in combination to obtain the signal that actually controls an actuator. Here, a selector module 1140 selects a highest of three input signals, 1011, 1016 and 1022 to obtain the port engine RPM actuator control signal 1050. A similar selector module 1141 selects a highest of three input signals, 1014, 1018 and 1023 to obtain the starboard engine RPM actuator control signal 1051.

Additionally, a summation module 1142 sums the two input signals 1010 and 1017 to obtain the port reversing bucket position actuator control signal 1052. Another summation module 1143 sums the two input signals 1013 and 1019 to obtain the starboard reversing bucket position actuator control signal 1053. Yet another summation module 1144 sums the two input signals 1012 and 1020 to obtain the port nozzle position actuator control signal 1054, and summation module 1145 sums the two input signals 1015 and 1021 to obtain the starboard nozzle position actuator control signal 1055.

Figure 14A:
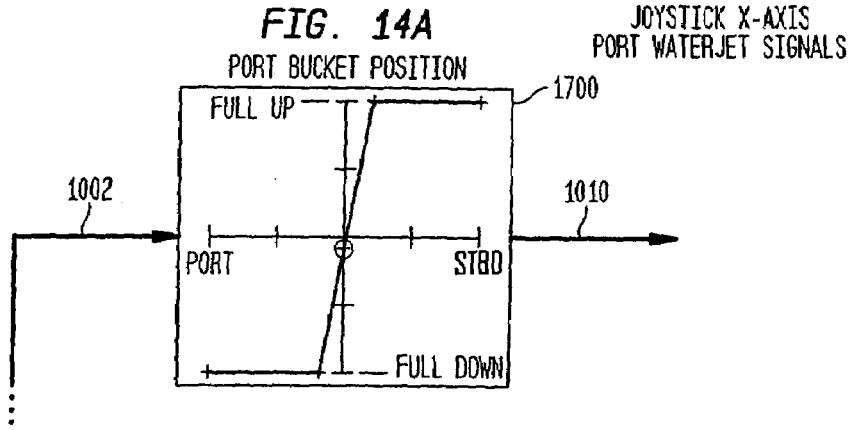
FIG. 14 illustrates an exemplary set of (port) control functions and signals for a dual waterjet vessel corresponding to motion of a control stick in the x-direction.
Figure 14B:
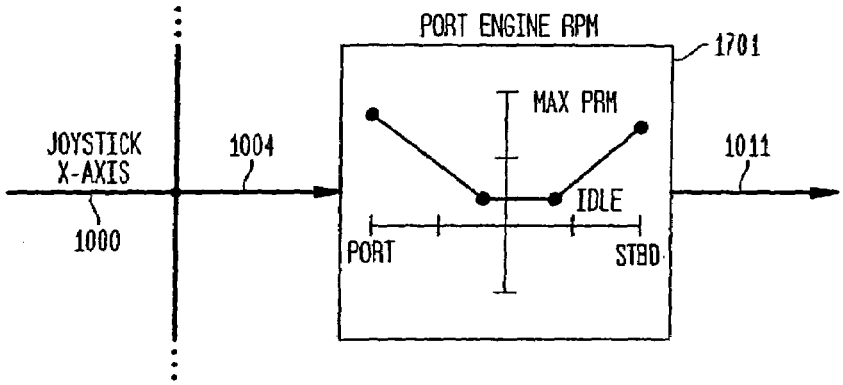
Figure 14C:
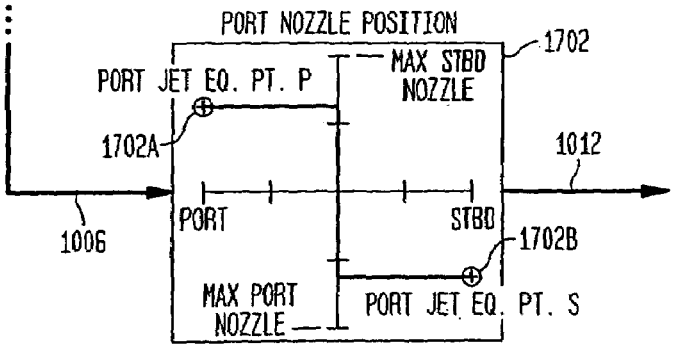

FIG. 14 illustrates the details of the algorithms and functions used to control the port reversing bucket actuator (FIG. 14(*a*)), the port engine RPM actuator (FIG. 14(*b*)) and the port nozzle position actuator (FIG. 14(*c*)). Three branch vessel control signals 1002, 1004 and 1006 branch out of vessel control signal 1000 corresponding to a position of the control stick 100 along the x-axis degree of freedom. The branch vessel control signals 1002, 1004 and 1006 are input to respective function modules 1700, 1701 and 1702, and output signals 1010, 1011 and 1012 are used to generate respective actuator control signals, as described with respect to FIG. 13, above.

As described previously, the x-axis degree of freedom of the control stick 100 is used to place the port reversing bucket approximately at the neutral position, and motion to starboard will raise the bucket and motion to port will lower the bucket (FIG. 14(*a*)). The setpoint 1700A is determined from an underway or free-floating calibration procedure to be the neutral reversing bucket position such that the net thrust along the major axis is substantially zero. Movement of the control stick 100 along the x-axis in the port direction affects nozzle, engine RPM and reversing bucket actuators. Optimum points for the port nozzle position (FIG. 14(*c*)), from 1702A and 1702B, are determined by dock-side or underway calibration as in obtaining point 1700A. Points 1702A and 1702B are of different magnitudes due to the geometry of the reversing bucket and different efficiency of the propulsion system when the reversing bucket is deployed compared to when the reversing bucket is not deployed.

Port engine RPM is lowest (idling) when the control stick 100 x-axis position is about centered. Port engine RPM is raised to higher levels when the control stick 100 is moved along the x-axis degree of freedom (FIG. 14(*b*)). The setpoints indicated by the dark circles are set at the factory or configured at installation, based on, e.g., vessel design parameters and specifications.

Figure 15A:
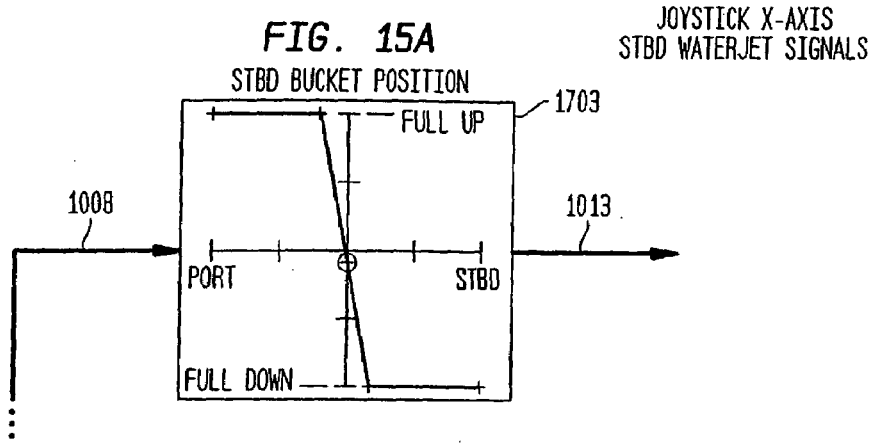
FIG. 15 illustrates an exemplary set of (starboard) control functions and signals for a dual waterjet vessel corresponding to motion of a control stick in the x-direction.
Figure 15B:
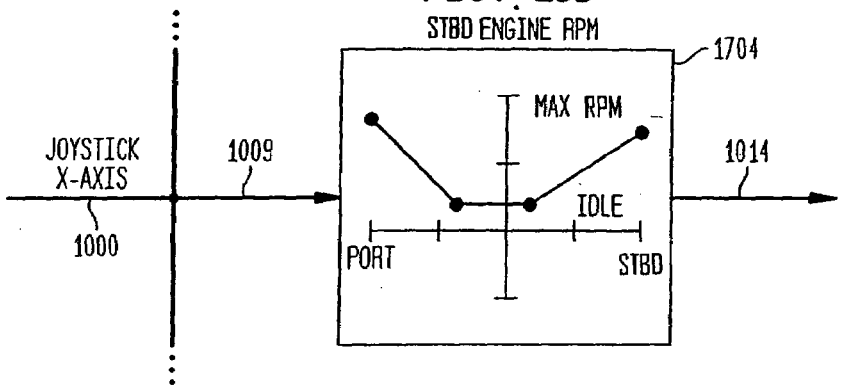
Figure 15C:
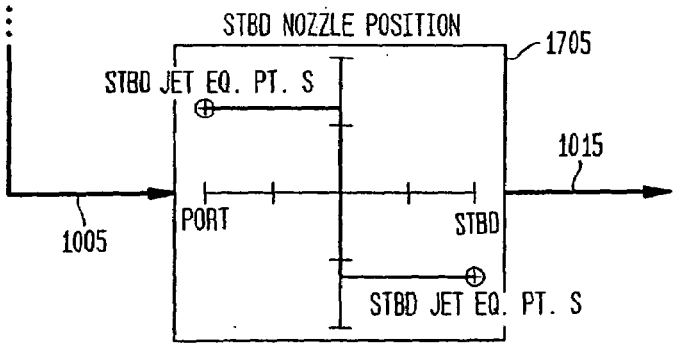

FIG. 15 illustrates the details of the algorithms and functions used to control the starboard reversing bucket actuator (FIG. 15(*a*)), the starboard engine RPM actuator (FIG. 15(*b*)) and the starboard nozzle position actuator (FIG. 15(*c*)). Three branch vessel control signals 1008, 1009 and 1005 branch out of vessel control signal 1000 (in addition to those illustrated in FIG. 14, above) corresponding to a position of the control stick 100 along the x-axis degree of freedom. The branch vessel control signals 1008, 1009 and 1005 are input to respective function modules 1703, 1704 and 1705, and output signals 1013, 1014 and 1015 are used to generate respective actuator control signals, as described with respect to FIG. 13, above. The calibration points and functional relationship between the output signals and the vessel control signal are analogous to those described above with respect to FIG. 14, and are not discussed.

Figure 16A:
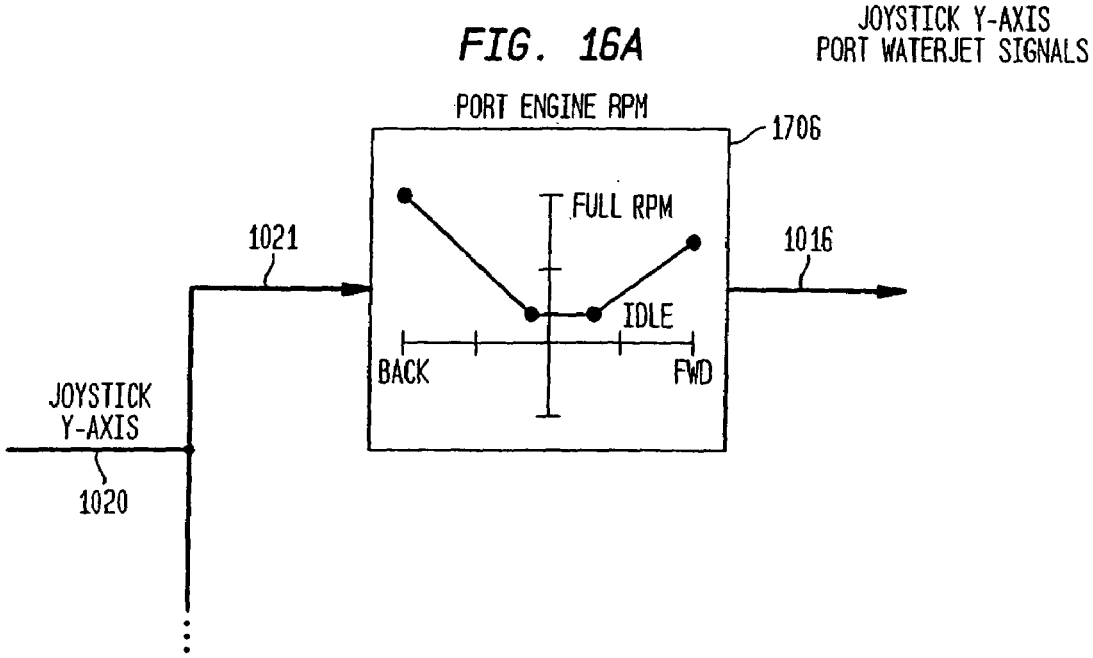
FIG. 16 illustrates an exemplary set of (port) control functions and signals for a dual waterjet vessel corresponding to motion of a control stick in the y-direction.
Figure 16B:
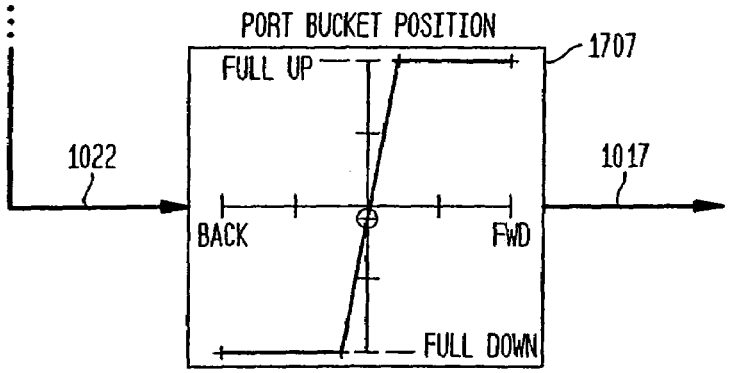

FIG. 16 illustrates the algorithms for generating control signals to control the port engine RPM actuator (FIG. 16(*a*)) and the port reversing bucket position actuator (FIG. 16(*b*)). Control stick 100 can move along the y-axis to provide vessel control signal 1020, which branches into signals 1021 and 1022, respectively being inputs to function modules 1706 and 1707. Function modules 1706 and 1707 calculate output signals 1016 and 1017, which are respectively used to control the port engine RPM actuator and the port reversing bucket position actuator of the system illustrated in FIG. 13. The port engine RPM varies between approximately idle speed in the vicinity of zero y-axis deflection to higher engine RPMs when the control stick 100 is moved along the y-axis degree of freedom (FIG. 16(*a*)). The port reversing bucket 154P is nominally at a neutral thrust position when the control stick 100 y-axis is in its zero position, and moves up or down with respective forward and backward movement of the control stick 100 (FIG. 16(*b*)).

Figure 17A:
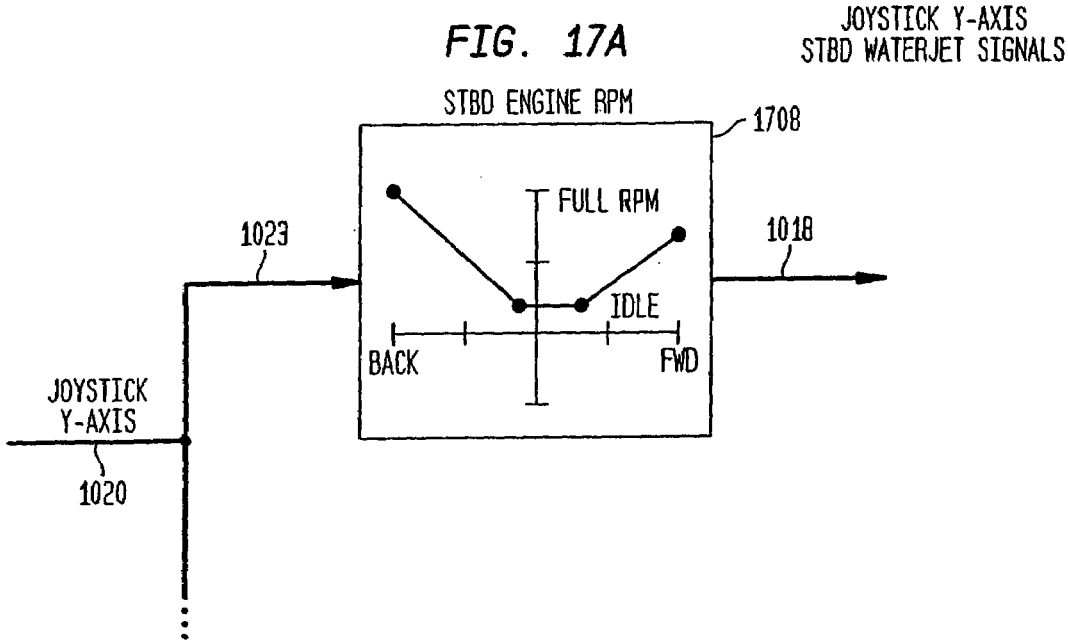
FIG. 17 illustrates an exemplary set of (starboard) control functions and signals for a dual waterjet vessel corresponding to motion of a control stick in the y-direction.
Figure 17B:
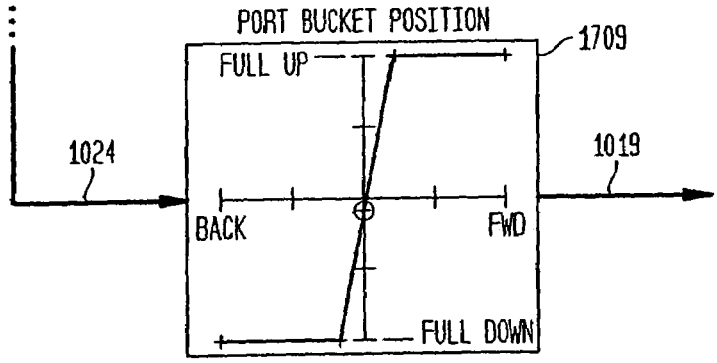

FIG. 17 illustrates the algorithms for generating control signals to control the starboard engine RPM actuator (FIG. 17(*a*)) and the starboard reversing bucket position actuator (FIG. 17(*b*)). Control stick 100 provides vessel control signal 1020 for movement along the y-axis, which branches into signals 1023 and 1024, respectively being inputs to function modules 1708 and 1709. Function modules 1708 and 1709 calculate output signals 1018 and 1019, which are respectively used to control the starboard engine RPM actuator and the starboard reversing bucket position actuator of the system illustrated in FIG. 13. The starboard engine RPM varies between approximately idle speed in the vicinity of zero y-axis deflection to higher engine RPMs when the control stick 100 is moved along the y-axis degree of freedom (FIG. 17(*a*)). The starboard reversing bucket 154S is nominally at a neutral thrust position when the control stick 100 y-axis is in its zero position, and moves up or down with respective forward and backward movement of the control stick 100 (FIG. 17(*b*)).

Figure 18A:
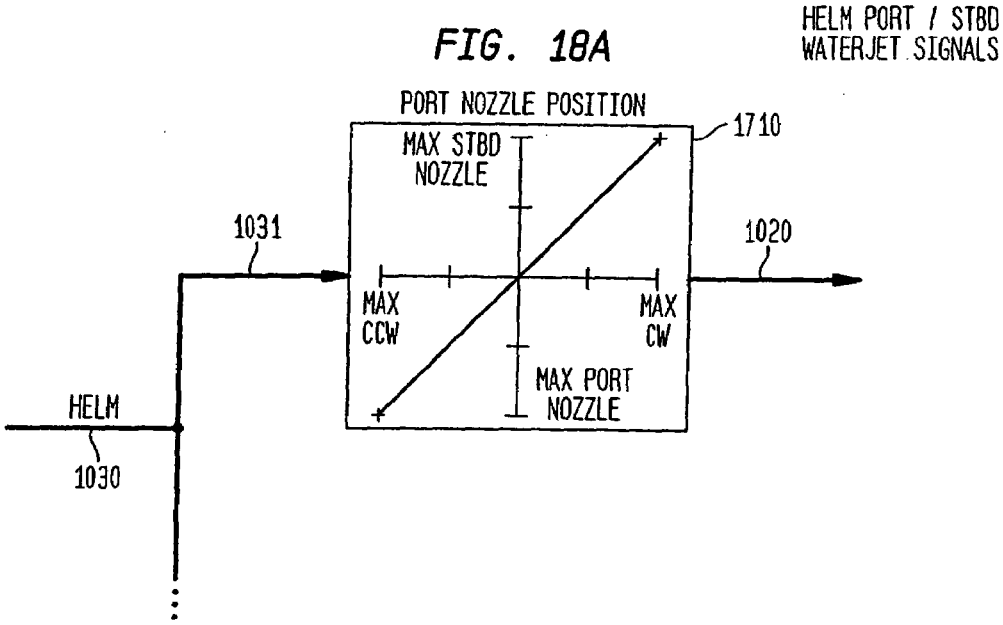
FIG. 18 illustrates an exemplary set of control functions and signals for a dual waterjet vessel corresponding to motion of a helm control apparatus.
Figure 18B:
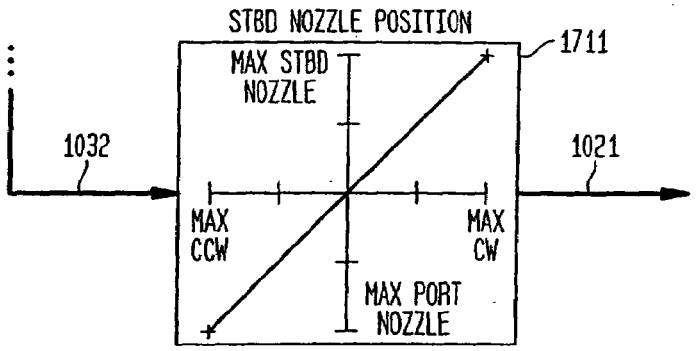

FIG. 18 illustrates the algorithms for generating control signals to control the port and starboard steering nozzle position actuators (FIGS. 18(*a*) and (*b*), respectively). Helm control 120 provides vessel control signal 1030, which branches into signals 1031 and 1032, respectively being inputs to function modules 1710 and 1711. Function modules 1710 and 1711 calculate linear output signals 1020 and 1021, which are respectively used to control the port and starboard steering nozzle position actuators of the system illustrated in FIG. 13.

Movement of the helm 120 n the clockwise direction results in vessel movement to starboard. Movement of the helm 120 in the counter-clockwise direction results in vessel movement to port. The functional relationships of FIGS. 18(*a*) and (*b*) are illustrative, and can be modified or substituted by those skilled in the art, depending on the application and desired vessel response.

Figure 19A:
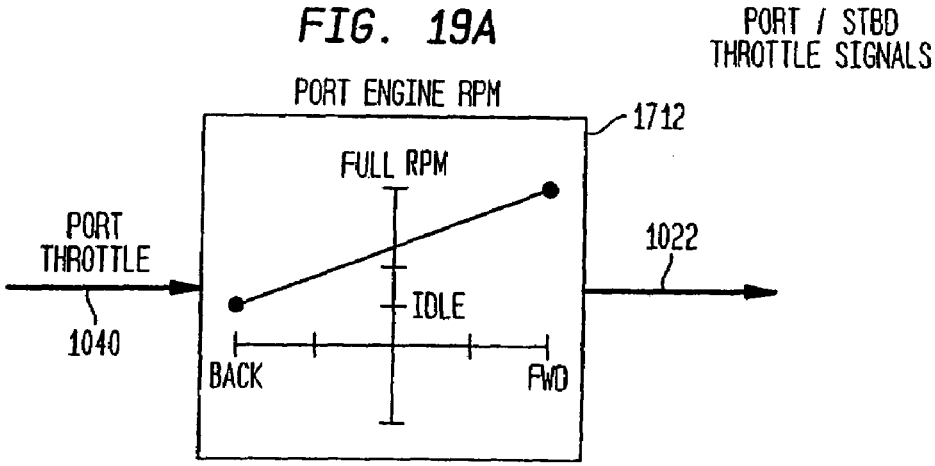
FIG. 19 illustrates an exemplary set of control functions and signals for a dual waterjet vessel corresponding to motion of a throttle control apparatus.
Figure 19B:
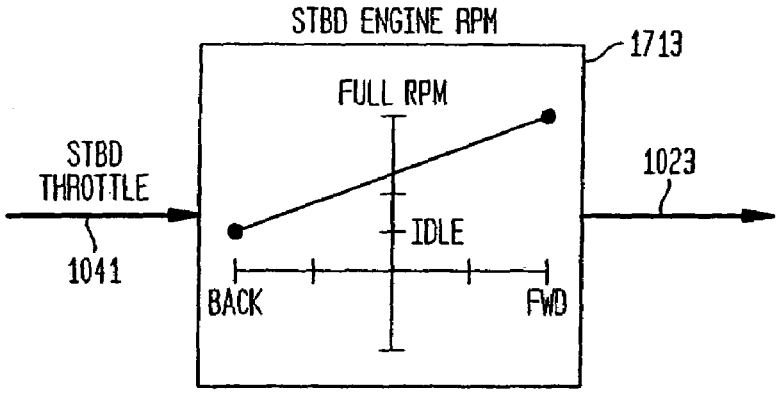

FIG. 19(*a*) illustrates the algorithm for generating a control signal used to control the port engine RPM actuator. Port throttle controller 110P generates a vessel control signal 1040 that is input to function module 1712. Function module 1712 determines a linear relation between input vessel control signal 1040 and output signal 1022. Thus, with the throttle in a full reverse position, the port engine actuator is in an idle position and with the throttle in the full forward position the port engine is at maximum RPM. The output signal 1022 is used as an input to provide the port engine RPM actuator control signal 1050, as illustrated in FIG. 13.

FIG. 19(*b*) illustrates the algorithm for generating a control signal used to control the starboard engine RPM actuator. Starboard throttle controller 110S generates a vessel control signal 1041 that is input to function module 1713. Function module 1713 determines a linear relation between input vessel control signal 1041 and output signal 1023. This relationship is substantially similar to that of the port engine RPM actuator. The output signal 1023 is used as an input to provide the starboard engine RPM actuator control signal 1051, as illustrated in FIG. 13.

Figure 20:
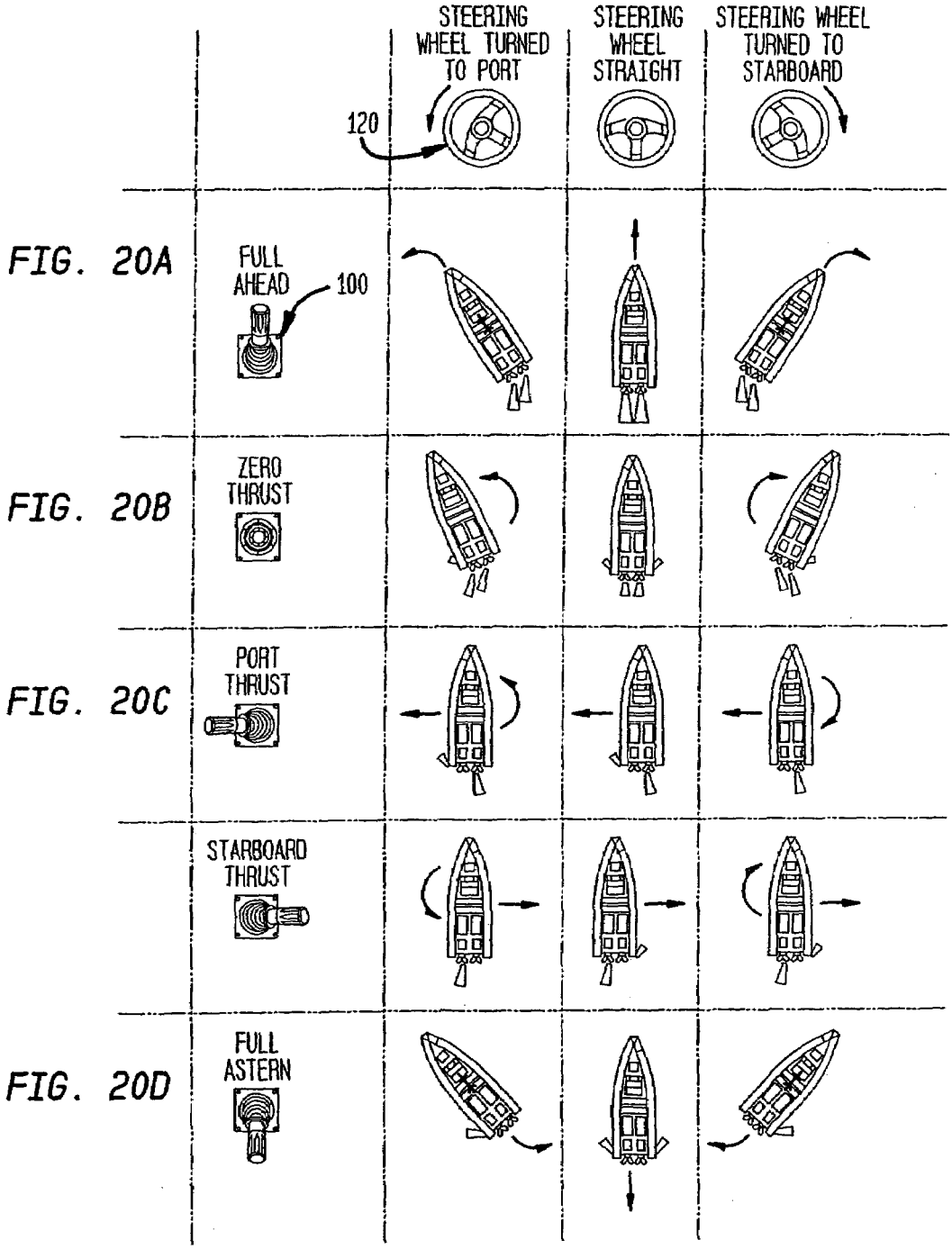
FIG. 20 illustrates exemplary maneuvers provided by motion of a control stick and helm for a dual waterjet vessel.

FIG. 20 illustrates a number of exemplary overall actual vessel motions provided by the control system described in FIG. 13 for a vessel having two propulsors with steering nozzles, two reversing buckets and no bow thruster.

FIG. 20(*a*) illustrates movement of the vessel to port along a curved path when the control stick 100 is in the forward (+y) and the helm 120 is in the turn-to-port position. If the helm 120 is placed in the straight ahead position the vessel moves forward only. If the helm 120 is turned clockwise the vessel moves to starboard FIG. 20(*b*) illustrates movement of the vessel when the control stick 100 is in the neutral center position. If the helm 120 is turned to port, the vessel rotates about a vertical axis to port. If the helm 120 is in the straight ahead position, no net vessel movement is achieved. Helm 120 motion to starboard is analogous to that for motion to port and will not be described for the sake of brevity.

FIG. 20(*c*) illustrates movement of the vessel when the control stick 100 is in the to-port position (−x). If the helm 120 is in the turn-to-port position then the vessel both rotates to port about a vertical axis and translates to port. If the helm 120 is in the straight ahead position then the vessel merely translates to port without net forward or rotation movement. Again, helm 120 motion to starboard is analogous to that for motion to port and will not be described for the sake of brevity. FIG. 20 also illustrates movement of the vessel when the control stick 100 is moved to the right (+x position).

FIG. 20(*d*) illustrates movement of the vessel when the control stick 100 is moved back in the (−y) direction. Here the vessel moves backwards and to the right if the helm 120 is in the to-port position, and the vessel moves straight back if the helm 120 is in the straight ahead position. Helm 120 motion to starboard is analogous to that for motion to port and will not be described for the sake of brevity.

As in the case for the single propulsor vessel, we see that vessel motion is in accordance with the movement of the vessel control apparatus. Thus, one advantage of the control system of the invention is that it provides a more intuitive approach to vessel control that can be useful for complex maneuvers such as docking. It is, of course, to be appreciated that the dynamics of vessel movement can vary widely depending on the equipment used and design of the vessel. For example, we have seen how a single-propulsor vessel and a dual-propulsor vessel use different actuator control signals to achieve a similar vessel movement. One aspect of the present invention is that it permits, in some embodiments, for designing and implementing vessel control systems for a large variety of marine vessels. In some embodiments, adapting the control system for another vessel can be done simply by re-programming the algorithms implemented by the above-described function modules and/or re-calibration of the key points on the above-described curves, that determine the functional relationship between a vessel control signal and an actuator control signal.

One aspect of marine vessel operation and control that may cause differences in vessel response is the design and use of the reversing buckets. Two types of reversing buckets are in use with many waterjet-propelled vessels: an "integral" design, which rotates laterally with a steering nozzle to which it is coupled, and a "laterally-fixed" design, which does not rotate laterally with the steering nozzle, and remain fixed as the steering nozzle rotates. Both integral and laterally-fixed designs can be dropped or raised to achieve the reversing action necessary to develop forward, neutral or backing thrust, but their effect on vessel turning and lateral thrusts is different.

The control system of the present invention can be used for both types of reversing buckets, as well as others, and can be especially useful for controlling vessels that have the laterally-fixed type of reversing buckets, which have traditionally been more challenging to control in an intuitive manner, as will be explained below. The following discussion will illustrate the two types of reversing buckets mentioned above, and show how their response differs. The following discussion also illustrates how to implement the present control system and method with the different types of reversing buckets.

Figures 21A, 21B, 21C:
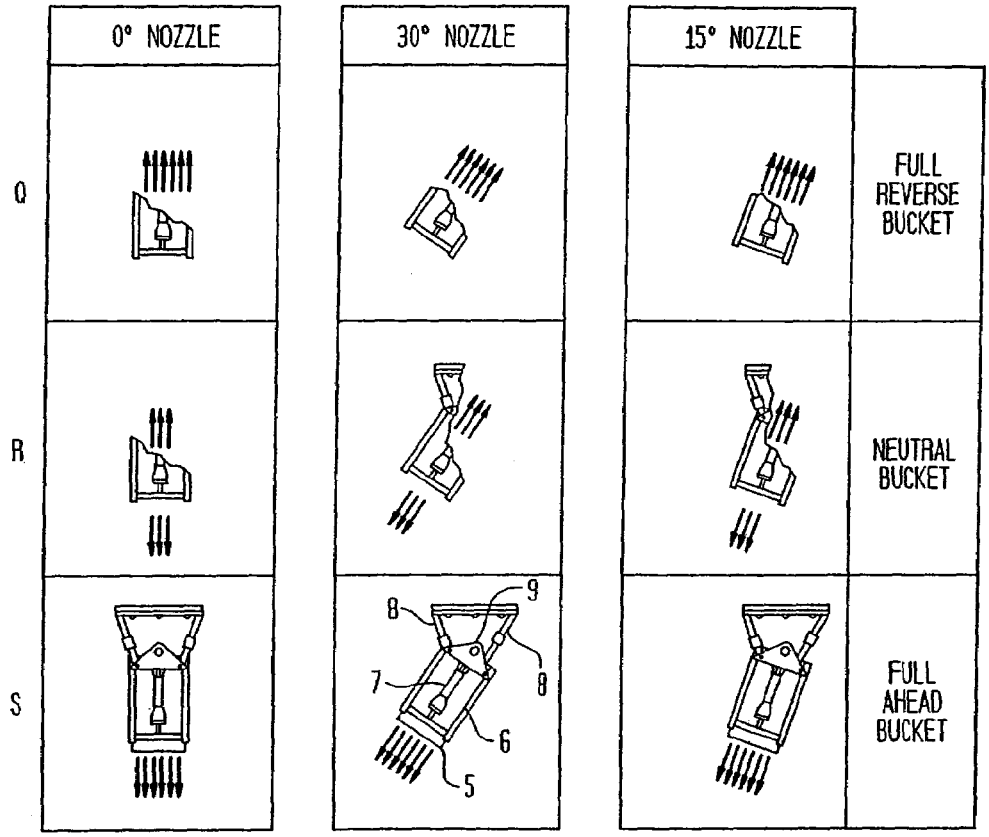
FIG. 21 illustrates an exemplary subset of motions of an integral reversing bucket and steering nozzle.

FIG. 21 illustrates an integral-type reversing bucket 5 that can be raised and lowered as described previously using reversing bucket actuator 7. The reversing bucket 5 and actuator 7 are coupled to, and laterally rotate with steering nozzle 6. The steering nozzle 6 and reversing bucket 5 assembly rotates laterally by movement of steering nozzle actuators 8, pivoting on trunion 9.

Several exemplary modes of operation of the combined reversing bucket and steering nozzle are illustrated in FIG. 21. The columns of the figure (A, B and C) illustrate the steering nozzle 6 being turned along several angles (0°, 30°, 15°) of lateral rotation. The rows (Q, R and S) illustrate several positions (full reverse, neutral and full ahead) of the reversing bucket 5. In the figure, the forward direction is to be understood to be toward the top of the figure and the aft direction is to the bottom, accordingly, the port direction is to the left and the starboard direction is to the right of the figure.

FIG. 21 (col. A, row Q) illustrates the steering nozzle 6 in a 0° position (straight ahead) and the reversing bucket 5 in the full-reverse (lowered) position. The resulting combined thrust is then in the backing direction with no net lateral component. The arrows show the resulting direction of flow of water, which is generally opposite to the direction of the resulting thrust on the vessel.

FIG. 21 (col. A, row R) and (col. A, row S) also illustrates the steering nozzle 6 in the straight ahead position, but the reversing bucket 5 is in the neutral position (col. A, row R) and in its raised position (col. A, row S). Accordingly, no net thrust is developed on the vessel in (col. A, row R) and full ahead thrust is developed on the vessel in (col. A, row S).

FIG. 21 (col. B, row Q-col. B, row S) illustrates the steering nozzle 6 turned 30° with respect to the vessel's centerline axis. By progressively raising the reversing bucket 5 from the backing position (col. B, row Q) to the neutral position (col. B, row R), or the ahead position (col. B, row S) thrust is developed along an axis defined by the direction of the steering nozzle 5. That is, in an integral reversing bucket design, the net thrust developed by the combined reversing bucket and steering nozzle is along a direction in-line with the steering nozzle axis.

FIG. 21 (col. C, row Q-col. C, row S) illustrates a similar maneuver as that of FIG. 21 (col. B, row Q-col. B, row S), except that the angle of steering is 15° with respect to the vessel's centerline rather than 30°.

Figure 22A:
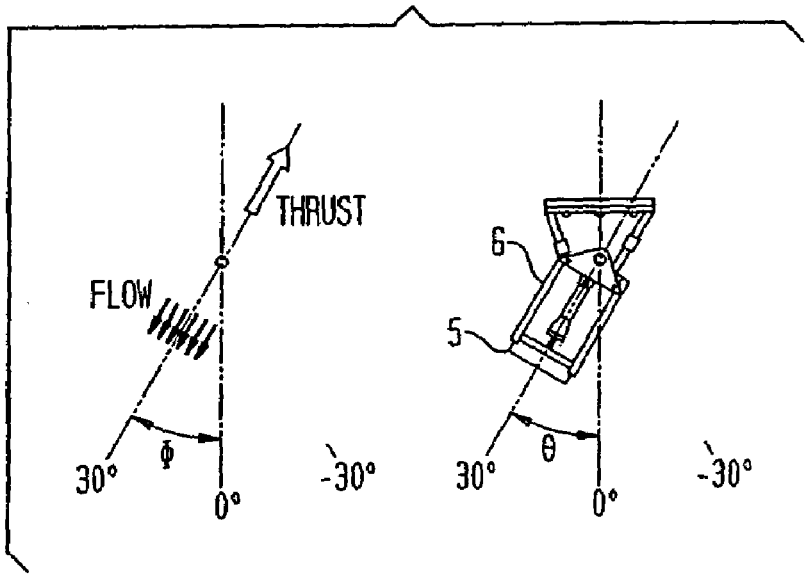
FIG. 22 illustrates thrust and water flow directions from the integral reversing bucket and steering nozzle of FIG. 21.
Figure 22B:
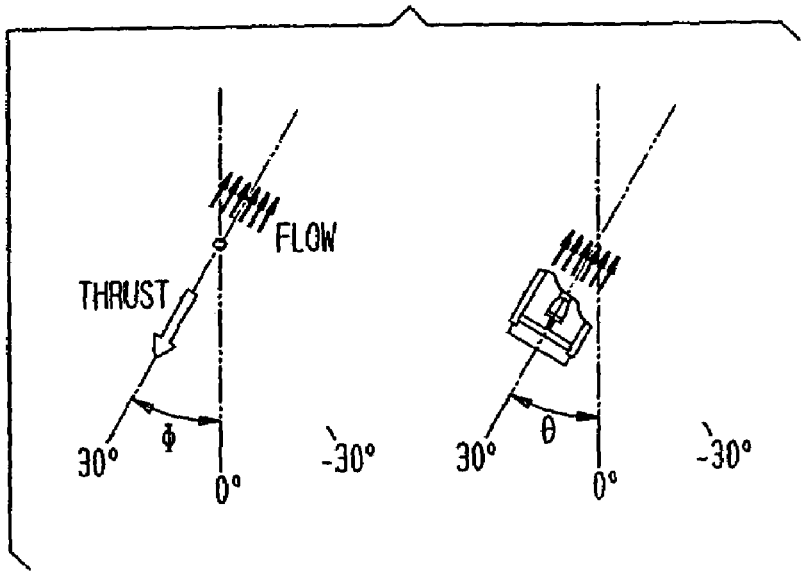

FIG. 22 illustrates the relation between the water flow direction and the resulting thrust for a configuration having an integral-type reversing bucket 5 coupled to a steering nozzle 6 as in FIG. 21. FIG. 22(*a*) illustrates a case with a 30° steering angle and the reversing bucket 5 in the full ahead (raised) position, as shown before in FIG. 21 (col. B, row S). The waterjet flow direction is in the same direction as the steering nozzle 5, with a resulting net thrust being forward and to starboard at an angle of substantially 30°.

FIG. 22(*b*) illustrates the steering nozzle 6 at a 30° steering angle and the reversing bucket 5 being in the full reverse (lowered) position as illustrated in FIG. 21 (col. B, row Q). The resulting flow is in a direction along the axis of the steering nozzle 6, but reversed by 180° from it. The resulting net thrust is then to the rear and port side of the vessel. Note that vessel design and placement of the nozzle and bucket assembly can impact the actual direction of translation and rotation of the vessel resulting from application of said thrust at a particular location on the vessel.

Figure 23:
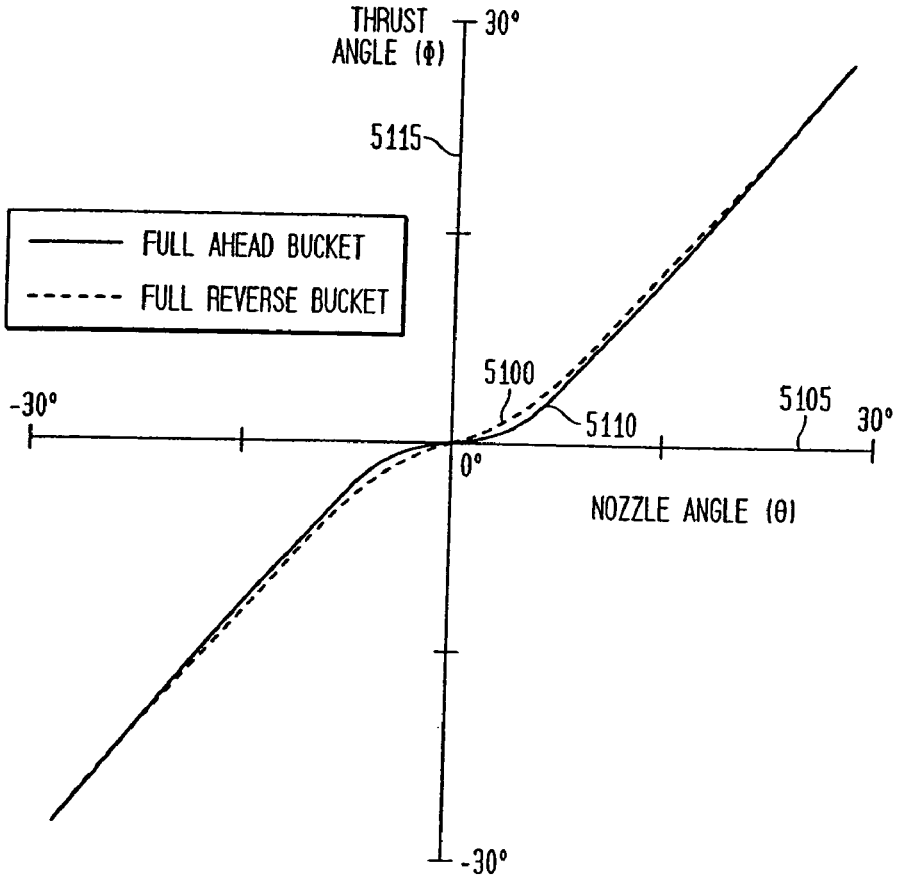
FIG. 23 illustrates plots of thrust angle versus nozzle angle for the integral reversing bucket and steering nozzle assembly of FIG. 21.

FIG. 23 illustrates the dynamic relationship between the steering nozzle 6 angle and the direction of the resulting thrust in a vessel using an integral reversing bucket 5. The horizontal axis 5105 represents an exemplary range of rotation of the steering nozzle 6 about the nominal 0° position (straight ahead). The vertical axis 5115 represents the angle of the thrust developed. Two curves are given to show the direction of the thrust for an integral reversing bucket 5 placed in the full ahead position (solid) 5110 and in the full reverse position (dashed) 5100. It can be seen that in either case, the direction of the thrust developed is substantially in-line with that of the applied steering nozzle direction. That is, the results for the full ahead position 5110 and the results for the full reverse position 5100 are in similar quadrants of the figure.

Figures 24A, 24B, 24C:
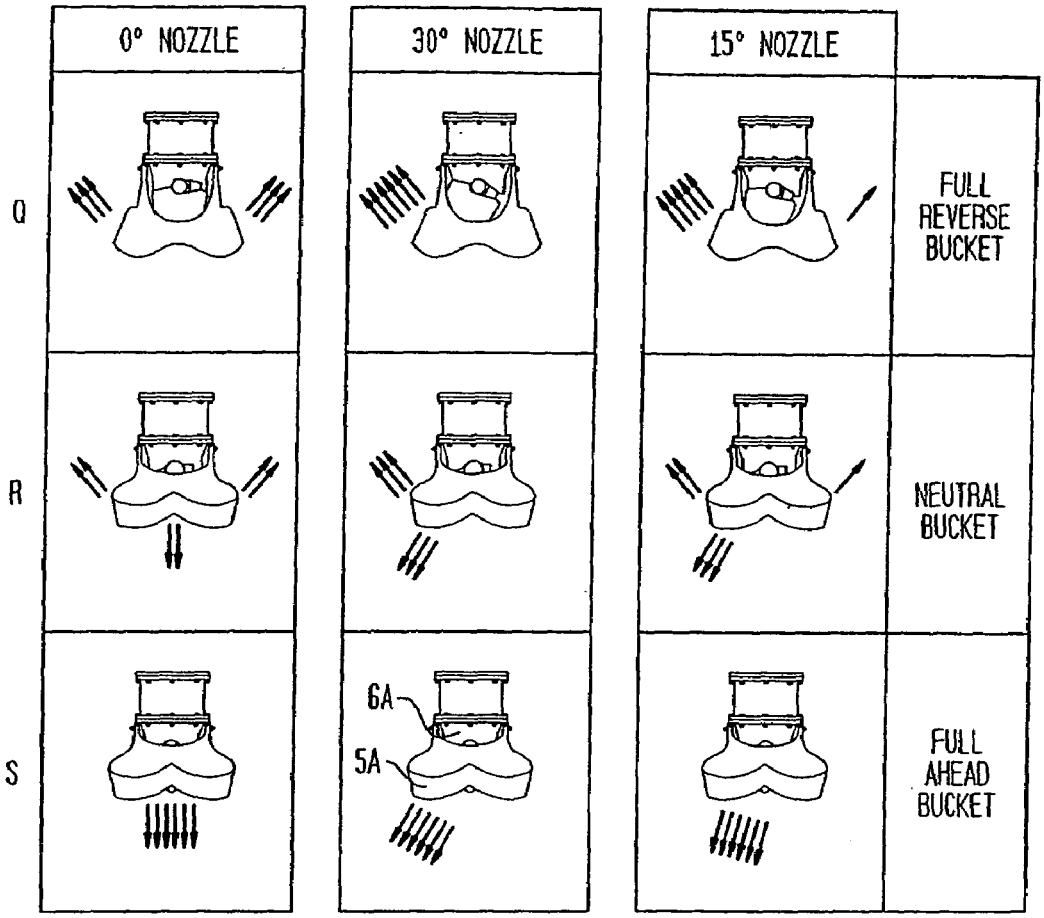
FIG. 24 illustrates an exemplary subset of motions of a laterally-fixed reversing bucket and steering nozzle.

FIG. 24 illustrates a laterally-fixed reversing bucket 5A that can be moved as described previously using a reversing bucket actuator (not shown in this figure). The reversing bucket 5A and its actuator are not coupled to the steering nozzle 6A, but are coupled to a waterjet housing or other support which is fixed to the vessel and do not rotate laterally with the steering nozzle 6A. The steering nozzle 6A rotates laterally by movement of steering nozzle actuators (not shown in this figure). Reference can be made to FIG. 5 which illustrates a more detailed side view of a laterally-fixed reversing bucket assembly and steering nozzle. A result of this configuration is that, in addition to reversing the forward-aft portion of the waterjet, the reversing bucket 5A redirects the water flow with respect to the vessel's centerline. In most designs, some curvature of the reversing bucket 5A surface exists and affects the exact direction in which the exiting water flows from the reversing bucket. Also, some designs of laterally-fixed reversing buckets comprise tube-like channels which force the flow to have a certain path along the tube. Others are split into a port and a starboard portion, such that the fraction of the waterjet traveling in the port or the starboard portions depends on the angle of the steering nozzle and affects the thrust accordingly.

Several exemplary modes of operation of the laterally-fixed reversing bucket 5A and steering nozzle 6A are illustrated in FIG. 24. The columns of the figure (A, B and C) illustrate the steering nozzle 6A being turned along several angles (0°, 30°, 15°) of lateral rotation. The rows (Q, R and S) illustrate several positions (full reverse, neutral and full ahead) of the reversing bucket 5A. As in FIG. 21, the forward direction is to the top of the figure and the aft direction is to the bottom, accordingly, the port direction is to the left and the starboard direction is to the right of the figure.

FIG. 24 (col. A, row Q) illustrates the steering nozzle 6 in a 0° position (straight ahead) and the reversing bucket 5A in the full-reverse (lowered) position. The resulting combined thrust is then in the backing direction with no net lateral component. Note that there are two lateral components to the waterjet flow in that the port and starboard contributions cancel one another. The arrows show the resulting direction of flow of water, which is generally opposite to the direction of the resulting thrust.

FIG. 24 (col. A, row R) and (col. A, row S) illustrates the steering nozzle 6A in the straight ahead position, but the reversing bucket 5A is in the neutral position in (col. A, row R) and in its raised position in (col. A, row S). No net thrust is developed with the reversing bucket 5A as illustrated in (col. A, row R) and full ahead thrust is developed with the reversing bucket 5A as illustrated in (col. A, row S).

FIG. 24 (col. B, row Q-col. B, row S) illustrates the steering nozzle 6A turned 30° with respect to the vessel's centerline axis. By progressively raising the reversing bucket 5A, from backing position (col. B, row Q), to neutral position (col. B, row R), or ahead position (col. B, row S) thrust is developed along an axis defined by the direction of the steering nozzle 6A. It can be seen, e.g. by comparing the thrust generated in FIG. 21 (col. B, row R) and FIG. 24 (col. B, row R), that the reversed component of the flow in the laterally-fixed reversing bucket 5A is not along the same axis as the steering nozzle 6A, while the integral reversing bucket 5 gave an in-line (but opposing) reversed flow component direction with respect to steering nozzle 6.

FIG. 24 (col. C, row Q-col. C, row S) illustrates a similar maneuver as that of FIG. 24 (col. B, row Q-col. B, row S), except that the angle of steering is 15° with respect to the vessel's centerline rather than 30°.

Figure 25A:
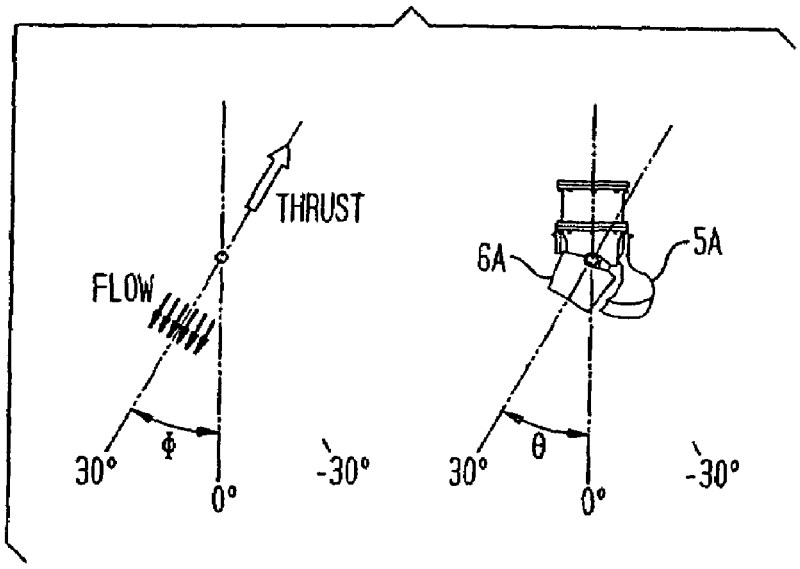
FIG. 25 illustrates thrust and water flow directions from the laterally-fixed reversing bucket and steering nozzle of FIG. 24.
Figure 25B:
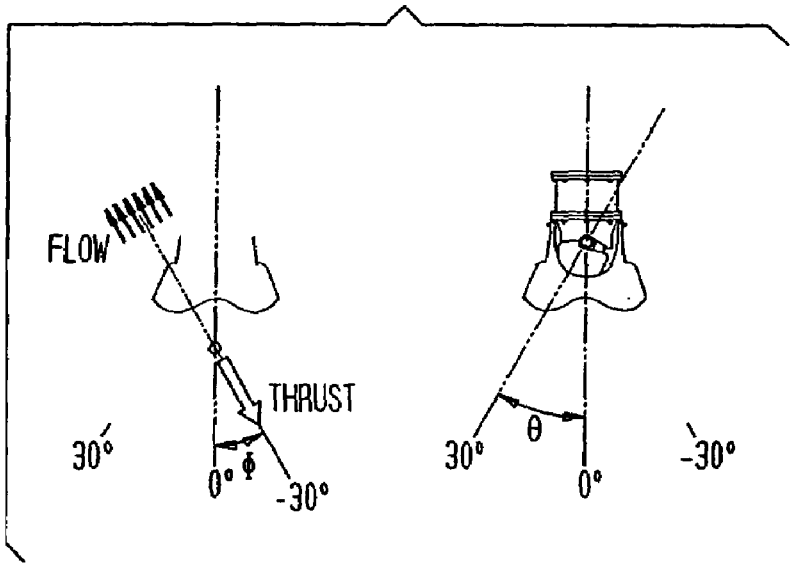

FIG. 25 illustrates the relation between the water flow direction and the resulting thrust for a configuration having a laterally-fixed type reversing bucket 5A and a steering nozzle 6A as illustrated in FIG. 24. FIG. 25(*a*) illustrates a case with a 30° steering angle of the steering nozzle 6A and the reversing bucket 5A in the full ahead (raised) position, as shown before in FIG. 24 (col. B, row S). The flow direction is in the same direction as that of the steering nozzle 5A, with a resulting net thrust being forward and to port.

FIG. 25(*b*) illustrates the steering nozzle 6A at a 30° steering angle to port and the reversing bucket 5A being in the full reverse (lowered) position. For this configuration, the resulting water flow is in a different direction than that of the steering nozzle 6A, and not along its axis. The resulting net thrust imparted to the vessel is to the rear and starboard side of the vessel. The reverse thrust can be at an angle greater than the 30° nozzle angle 6A because the flow channel within the reversing bucket 5A plays a role in steering the vessel. It is to be appreciated that the vessel design and placement of the nozzle and bucket assembly can impact the actual direction of translation and rotation of the vessel resulting from application of said thrust at a particular location on the vessel.

One thing that is apparent from comparing the integral and the laterally-fixed types of reversing buckets is that the lateral component of thrust due to the reversed component of the waterjet in the integral type reversing bucket is in a direction substantially reflected about the vessel's major axis (centerline) compared to the same thrust component developed by using a laterally-fixed reversing bucket. In other words, the resultant thrust for the integral reversing bucket 5 will be to the port side of the vessel, whereas the resultant thrust with the laterally-fixed reversing bucket 5A will be to the starboard side of the vessel.

Figure 26:
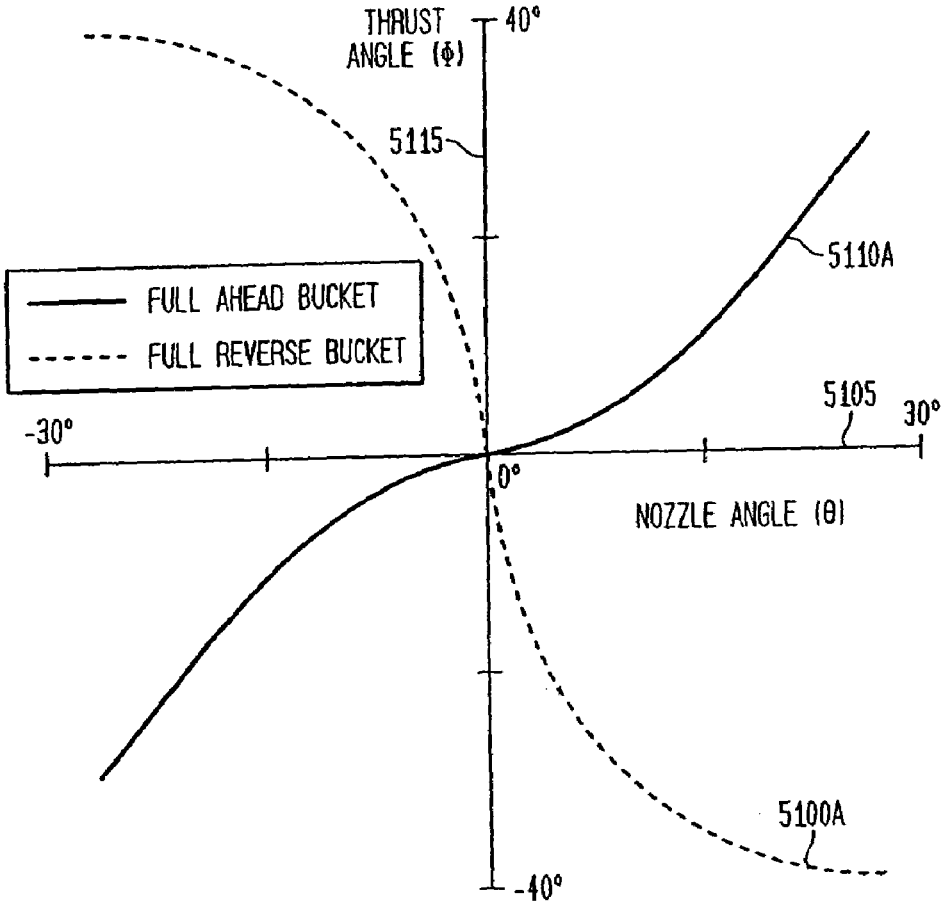
FIG. 26 illustrates plots of thrust angle versus nozzle angle for the laterally-fixed reversing bucket and steering nozzle assembly of FIG. 24.

FIG. 26 illustrates the dynamic relationship between the steering nozzle 6A angle and the direction of the resulting thrust in a vessel using a laterally-fixed reversing bucket 5A. The horizontal axis 5105 represents an exemplary range of rotation of the steering nozzle 6A about the nominal 0° position (straight ahead). The vertical axis 5115 represents the angle of the thrust developed. Two curves are given to show the direction of the thrust for a laterally-fixed reversing bucket 5A placed in the full ahead position (solid) 5110A and in the full reverse position (dashed) 5100A. It can be seen that in the full reverse case, the direction of the thrust developed is substantially out-of-line with that of the applied steering nozzle direction. That is, the results for the full ahead position 5110A and the results for the full reverse position 5100A are in different quadrants of the figure.

According to some aspects of the present invention, problems related to the use of laterally-fixed reversing buckets in some embodiments can be overcome. The primary problem with respect to controlling waterjets with laterally-fixed reversing buckets is predicting the overall effect of variable amounts of reverse thrust. This is a significant problem, as the reversing component is not only deflected substantially out of line with steering nozzle angle but at varying degrees with respect to nozzle position. Through the use of specially designed algorithms and simplified calibration methods, the present invention can anticipate and correct for such discrepancies and result in smooth, intuitive operation of the control system. This of course does not limit the scope of the present invention, and it is useful for many types of reversing buckets.

In some embodiments, the marine vessel may have coupled steering nozzles or propulsor apparatus. For example, it is possible to use two steering nozzles that are mechanically-coupled to one another and rotate in unison by installing a cross-bar that links the two steering nozzles and causes them to rotate together. A single actuator or set of actuators may be used to rotate both steering nozzles in this embodiment. Alternatively, the steering nozzles may be linked electrically through use of shared actuator control signals. It is possible to split an actuator control signal so that separate actuators controlling each steering nozzle are made to develop the same or similar movements.

Traditionally, systems which use two or more coupled steering nozzles experienced a reduction in overall maneuverability, as the nozzles cannot be independently controlled or rotated. However, the control system and techniques described herein allow for full motion and maneuverability because extra degrees of freedom and combinations of control gestures and maneuvers are made possible through the individualized movements of all vessel control devices according to set algorithms. One maneuver that is not possible using traditional controls in vessels with integral reversing buckets and coupled steering nozzles that can be performed using the present control system with a laterally-fixed reversing bucket system is a purely lateral translation of the vessel.

Figure 27:
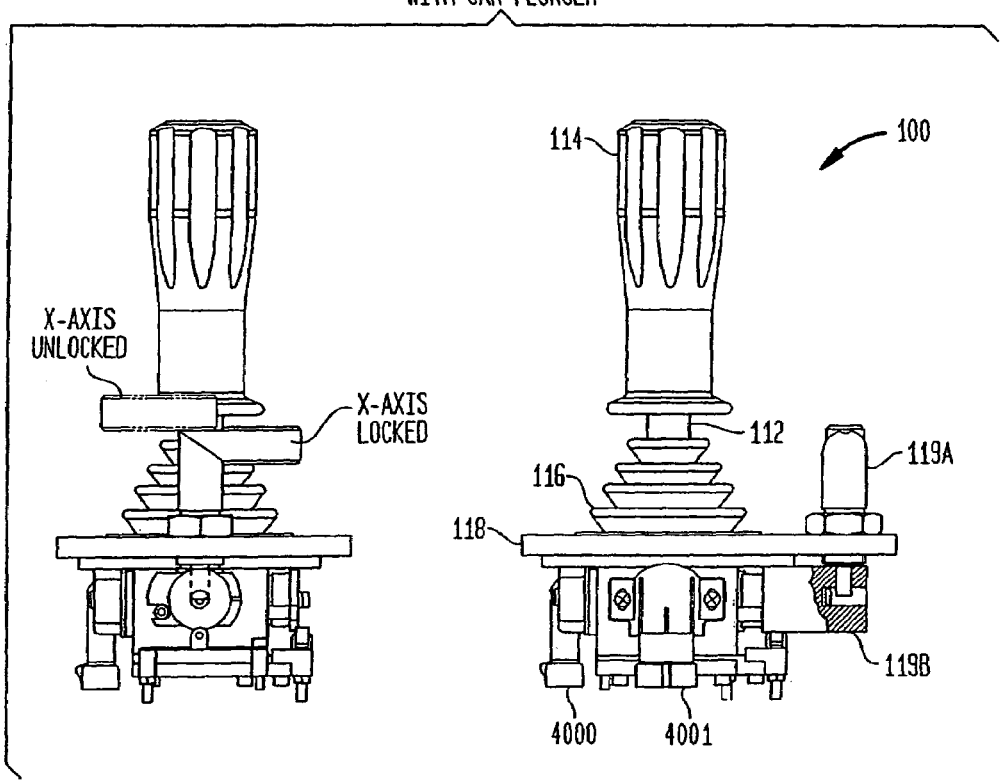
FIG. 27 illustrates an exemplary vessel control stick with a mechanical lockout device.

FIG. 27 illustrates one embodiment of a vessel control device according to the present invention that facilitates safe and intuitive vessel control. As discussed with regard to FIG. 2, a control stick 100 can comprise a joystick-style controller. The control stick 100 of FIG. 27 comprises a stalk 112 and a handle 114 for ease of handling. The control stick has a pivot or other means for articulation 116 near the base of the stalk and connects to a support member 118. Support member 118 may be integral to a dashboard or may be a stand-alone component, allowing after market installation into a control panel (not shown).

In addition to being able to move in the degrees of freedom already described, the control stick 100 also has a locking mechanism that locks out movement in one or more of the degrees of freedom. For example, it is illustrated that by turning a first part of a locking device (cam plunger 119A), mounted on support member 118, the cam plunger 119A may descend into a corresponding second part of the locking device (locking drum 119B) so that the control stick 100 is prevented from moving along the x-axis but can still move along the y-axis.

Figure 28:
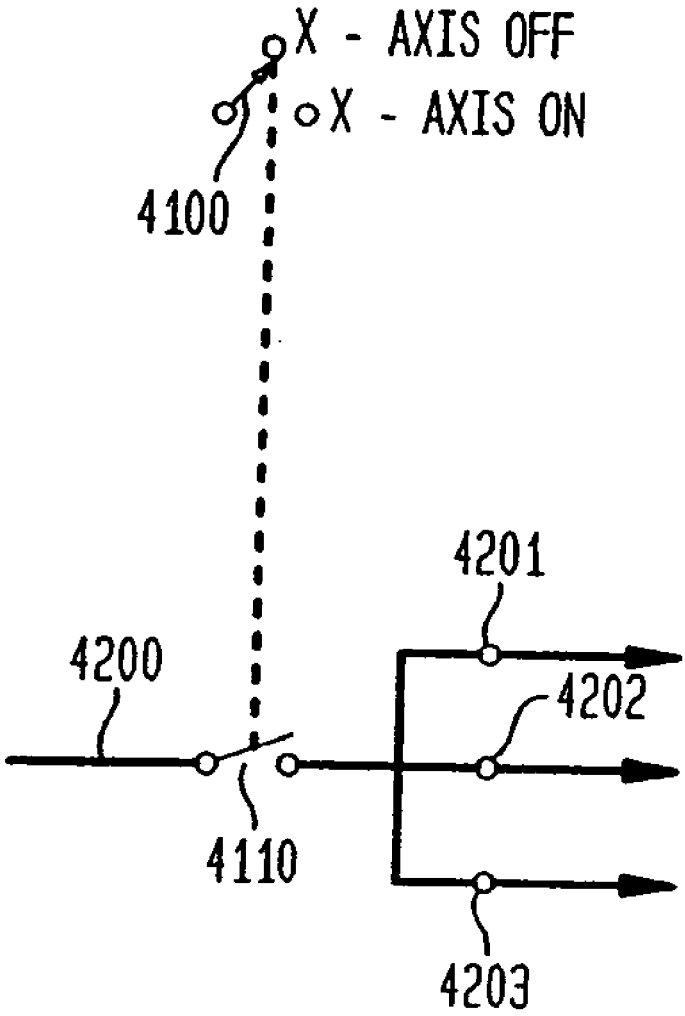
FIG. 28 illustrates an exemplary electrical interlock that can be used in a vessel control apparatus.

It is to be appreciated that many electrical and mechanical embodiments can provide the same functionality or its equivalent. Several types of pin-and-hole arrangements and locking screws could also be used. In addition, the locking device may comprise an electrical interlock that when activated opens an electrical switch that prevents vessel control signals from the affected degree of freedom from being provided by the vessel control devices and/or received by the respective actuators. Said switch may be directly actuated by, e.g. pressing an interlock button, or may be indirectly actuated by use of an electrical relay. FIG. 28 illustrates schematically a simple electrical interlock whereby a lockout device 4100 has two positions, one allowing x-axis detection (ON) and the other preventing x-axis detection (OFF). The lockout device 4100 is coupled mechanically or electrically to an electrical switch 4110. The switch 4110 can allow or prevent the x-axis vessel control signal 4200 from reaching the branch signals 4201, 4202 and 4203. By so doing, operation of the actuators by signals derived from motion of the x-axis of the vessel control apparatus (not shown) can be prevented or allowed, as selected by the lockout device.

Such interlocks may be useful in applications where one mode of operation and control of the vessel involves use of both the x and the y degrees of freedom (e.g., during docking maneuvers) while another mode of operation (e.g., open water cruising) does not require one of the degrees of freedom (e.g., the x-axis). This can be used, for example, prevent accidental actuation of controls such as reversing buckets and nozzles while operating at high speeds.

Another aspect of the invention relates to the way in which the control system interfaces to testing and calibration equipment. In some embodiments, troubleshooting and calibration of the control system can be accomplished using hand-held inexpensive interrogation and calibration equipment. Traditionally, bulky and expensive equipment, comprising a computer or an ASCII terminal, was interfaced through proprietary connections to the control system. A skilled technician would perform routine maintenance and calibration procedures because they required specialized equipment and knowledge. By contrast, the present invention uses flexible and modular components, such as the above-described functional elements and modules of the control processor unit 130, that can be tested, programmed and re-adjusted more easily using standard computers or even handheld personal digital assistants (PDAs). As discussed above, in one embodiment of the control system, the conversion of vessel control signals from vessel control devices to actuator control signals is done in software executing on a control processor unit 130. Standard connections, including serial and universal serial bus (USB), as well as infra-red connections between the control system and the interrogating device can be used, and those skilled in the art will understand the details of implementing such coupling.

Figure 29:
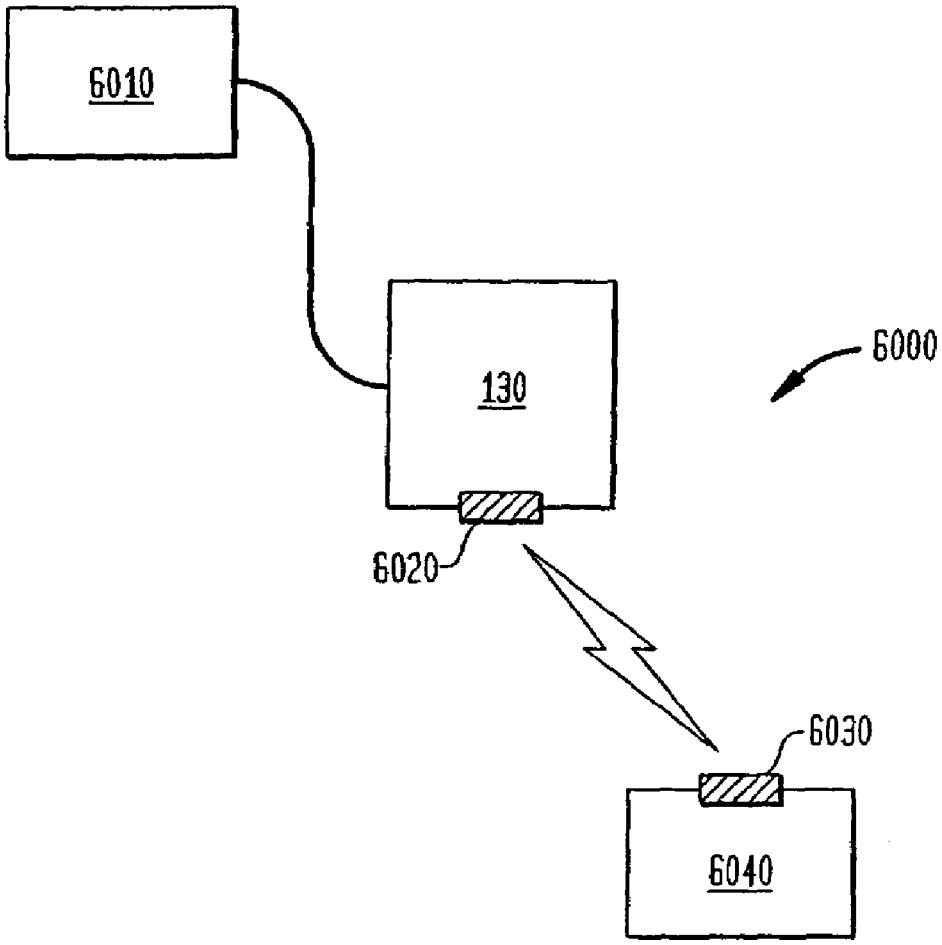
FIG. 29 illustrates an exemplary embodiment of an interrogator unit communicating with a control processor unit.

FIG. 29 illustrates an exemplary control system 6000, having a vessel control apparatus 6010 and a control processor unit 130. The control processor unit 130 comprises a connection 6020 designed for coupling the control system 6000 to a test or calibration device 6040. The test or calibration device 6040 has a connection 6030 that allows for coupling, as described above, to the connection 6020 on the control processor unit. The coupling of connections 6020 and 6030 can be of any type suitable to carry data or information between the control system 6000 and the test or calibration device 6040 (sometimes called an interrogator). The physical connection can be made using any cable with appropriate ends, such as a serial connection or a USB connection or an infrared connection.

The present invention provides, in some embodiments, three levels of configuration/calibration: 1) Set at factory or installation 2) Set dockside 3) Set under maneuvering conditions.

Some configuration parameters such as engine idle and maximum RPM can be preprogrammed at the factory or during installation. Other parameters such as extreme actuator points will vary from application to application. These points can be calibrated quickly and efficiently by performing an automatic calibration routine with the vessel at the dock. During dockside calibration, all actuators are automatically moved by the controller to sense the extreme positions, and the control stick, helm and throttles are manually moved from one extreme to the other such that the controller can sense the extreme positions of each devise. The third level of calibration is applied to maneuvering parameters designated with a cross inside of a circle in FIGS. 8–11 and 14–19. The operator places the joystick into known reference positions (e.g., centered or hard to port) and observes the ensuing motion of the vessel. If the vessel is supposed to translate laterally to port and instead is moving slightly forward or slowly rotating in addition to translating to port, then adjustment is required. The operator can compensate using the vessel control apparatus until the correct desired motion (translation to port) occurs. That is, the operator can use one or more vessel control apparatus to move the vessel in a reference maneuver at which time the operator selectively activates the calibration capture button to calibrate the control signals. At this time, the operator can depress a "calibrate" or a "store" button for example that will set or store one or more key points in the modules within the control processor unit 130. The same procedure can be applied to the condition where the joystick is centered (i.e., neutral thrust.)

This procedure can compensate for individual aspects of a marine vessel, as each vessel could be unique in its configuration, options, or equipment installed therein following delivery from the factory. Additionally, the procedure described above can be performed periodically to adjust for changing parameters that change over a vessel's lifetime. Also, if new equipment, e.g. fishing rigs, batteries, or other cargo causes the vessel to deviate from its ideal control characteristics, then the control system can be so re-calibrated to accommodate these changes.

According to some embodiments, by employing electrical control signals in the electrical portion of the control system, it is possible to minimize hazards and cost associated with hydraulic and mechanical controllers and components. Electrical wiring and components may be generally produced at a lower cost than hydraulic components and control apparatus that have to reliably bear high hydraulic system pressures. Furthermore, hydraulic pressure surges or shocks associated with, e.g., hydraulic helm systems are avoided by using electrical vessel control apparatus as described herein.

One aspect of the present invention permits increased reliability of the electrical components of the control system by using appropriate signal protection techniques. In some embodiments of the present invention the inputs and outputs of the function modules or other components are electrically isolated using inexpensive optical couplers. This way, signals are allowed to pass through the optical couplers but electrical faults will be prevented from propagating through the system. This can be especially useful in marine applications, where water is always a hazard to electrical wiring and components because of its ability to cause short circuits in the control system. Of course, other isolation techniques are known, and one skilled in the art would appreciate the need to package and install the present control system such that any adverse effects of sea water leakage into the electrical components are minimized.

Figure 30:
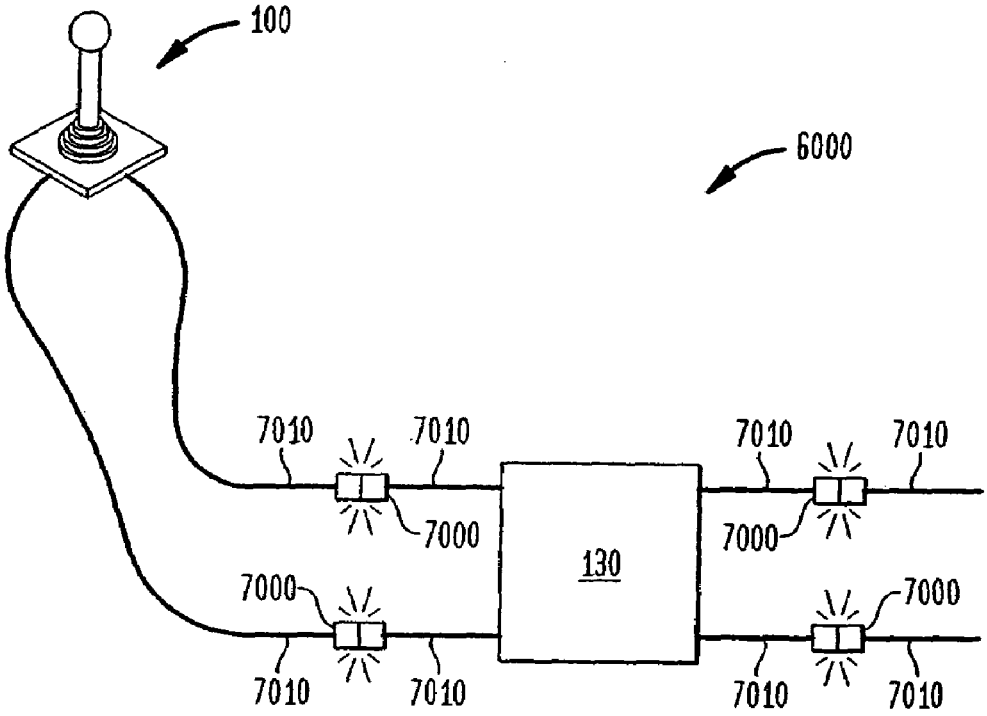
FIG. 30 illustrates an exemplary portion of a vessel control system having isolators to isolate parts of an electrical circuit from one another.

FIG. 30 schematically illustrates a portion of such an exemplary control system 6000. A control stick 100 delivers vessel control signals through electrical conductors 7010, such as would be connected to a potentiometer (not shown). The vessel control signals are transmitted by optical isolators 7000 placed in the electrical line 7010 to isolate a control processor unit 130 from the control stick 100 and connections thereto. Many such isolation points can be selected to achieve a compartmentalized circuit having several isolated parts.

The concepts presented herein may be extended to systems having any number of control surface actuators and propulsors and are not limited to the embodiments presented herein. Modifications and changes will occur to those skilled in the art and are meant to be encompassed by the scope of the present description and accompanying claims. It is, therefore, to be understood that the appended claims are intended to cover all such modifications and changes as fall within the range of equivalents and understanding of the invention.

What is claimed is:

1. A method for controlling a marine vessel having a first steering nozzle, a reversing bucket and one of a bow thruster and a second steering nozzle, comprising:

receiving a first vessel control signal from a first vessel control apparatus having at least two degrees of freedom, the first vessel control signal corresponding to a movement of the first vessel control apparatus along at least one degree of freedom;

receiving a second vessel control signal corresponding to movement of a second vessel control apparatus along a third degree of freedom; and generating at least a first actuator control signal and a second actuator control signal;

wherein the first actuator control signal is coupled to and controls the first steering nozzle, and the second actuator control signal is coupled to and controls one of the second steering nozzle, the reversing bucket, and the bow thruster; and inducing a net translational force to the marine vessel, in response to the first actuator control signal and the second actuator control signal, so that substantially no net rotational force is induced to the marine vessel as a result of movement of the first vessel control apparatus and with the second vessel control apparatus in a neutral position; and inducing a net force to the marine vessel substantially in a same direction as movement of the first vessel control apparatus and the second vessel control apparatus, for all movements of the first vessel control apparatus along the two degrees of freedom and for all movements of the second vessel control apparatus along the third degree of freedom.

2. The method of claim 1, wherein the act of generating the first actuator control signal and the second actuator control signal comprises calculating the first and second actuator control signals with at least one algorithm configured to apply the net translational force to the marine vessel along the same direction as movement of the first vessel control apparatus in response to receiving the first vessel control signal as an input.

3. The method of claim 1, further comprising moving the first vessel control apparatus along a single degree of freedom that provides the first and second actuator control signals to respective first and second actuators to provide the net force to the vessel in a direction corresponding primarily to the single degree of freedom.

4. The method of claim 1, wherein the act of generating at least the first actuator control signal and the second actuator control signal comprises also generating a third actuator control signal, and wherein the second actuator control signal is coupled to and controls the bow thruster and the third actuator control signal is coupled to and controls the reversing bucket.

5. The method of claim 1, wherein one of the first and second actuator control signals controls a speed of a prime mover of a waterjet propulsor corresponding to at least one of the first and second steering nozzles.

6. The method of claim 1, wherein one of the first and second actuator control signals controls an angular position of rotation of at least one of the first and second steering nozzles.

7. The method of claim 1, wherein the act of generating the first actuator control signal and the second actuator control signal comprises generating a set of the first actuator control signals for controlling the first and second steering nozzles and generating a set of the second actuator control signals for controlling at least two reversing buckets.

8. The method of claim 1, further comprising calibrating key operating points in a function relating the vessel control signal to a corresponding actuator control signal during a reference maneuver of the vessel.

9. The method of claim 1, further comprising moving the reversing bucket in substantially only one degree of freedom with respect to the vessel to provide varying amounts of thrust.

10. The method of claim 1, further comprising controlling the first and second steering nozzles so that they rotate substantially in unison.

11. The method of claim 1, further comprising automatically detecting and storing key parameters of any of the first and second steering nozzles, the reversing bucket and the bow thruster during a reference maneuver of the marine vessel.

12. The method of claim 11, further comprising implementing the key parameters to perform a maneuver of the marine vessel that corresponds to the reference maneuver.

13. The method of claim 1, further comprising recording key parameters of any of the first and second steering nozzles, the reversing bucket and the bow thruster, in response to actuating an input device during a reference maneuver of the marine vessel.

14. The method of claim 1, further comprising controlling the first steering nozzle and the bow thruster with movement of the first vessel control apparatus along a transverse axis to induce a transverse force to the marine vessel.

15. The method of claim 14, further comprising actuating the first and second actuator control signals to simultaneously control the first steering nozzle and the bow thruster.

16. The method of claim 14, further comprising providing an equal transverse thrust from each of the bow thruster and a combination of a reversing bucket and the steering nozzle for a neutral position of the second vessel control apparatus.

17. The method of claim 14, further comprising controlling the first steering nozzle in combination with the reversing bucket and the bow thruster to induce substantially only a net transverse force to the marine vessel with movement of the first vessel control apparatus along only a transverse axis and the second control apparatus being in a neutral position.

18. The method of claim 1, further comprising modifying the first and second actuator control signals based on the second vessel control signal so as to create a differential transverse thrust between a combination of the first steering nozzle and the reversing bucket and the bow thruster, to induce a rotational force to the marine vessel.

19. The method of claim 18, further comprising rotating the second vessel control apparatus to provide the second vessel control signal to impart a rotational only force that does not induce any substantial translational force to the marine vessel.

20. The method of claim 1, further comprising actuating the first steering nozzle in combination with a reversing bucket to provide a reverse thrusting waterjet, and actuating the second steering nozzle in combination with a second reversing bucket to provide a forward thrusting waterjet, in response to transverse motion of the first vessel control apparatus, and providing an angle of the first steering nozzle, measured from a straight ahead position, that is less than an angle of the second steering nozzle, measured from the straight ahead position.

21. The method of claim 20, further comprising configuring the reverse thrusting waterjet with a first revolutions per minute (RPM) value, and configuring the forward thrusting waterjet with a second RPM value, and configuring the first RPM value to be higher than the second RPM value.

22. The method of claim 1, wherein the marine vessel comprises the first and second steering nozzles, and further comprising an act of maintaining the first and second steering nozzles at a fixed position for all movements of the first vessel control apparatus to one of a port and starboard side of a neutral position while maintaining the second vessel control apparatus at a fixed position.

23. The method of claim 1, wherein the act of inducing a net force to the marine vessel, in response to at least one of the first and second actuator control signals, comprises imparting only a net rotational force to the marine vessel in response to the movement of the second vessel control apparatus along the third degree of freedom.

24. The method of claim 1, wherein the act of inducing a net force to the marine vessel in response to the first and second actuator control signals includes inducing a rotational force to the marine vessel in response to the movement of the second vessel control apparatus along the third degree of freedom without inducing any substantial translational force to the marine vessel, for the first vessel control apparatus in a neutral position.

25. The method of claim 1, wherein the act of receiving the first vessel control signal comprises receiving two vessel control signals, each signal corresponding to a single degree of freedom of the first vessel control apparatus.

26. The method of claim 1, wherein the act of inducing the net translational force to the marine vessel comprises pointing the first steering nozzle and the second steering nozzle to one of a port and starboard side in response to movement of the first vessel control apparatus along a transverse axis.

27. The method of claim 26, wherein the act of inducing the net translational force to the marine vessel further comprises pointing the first steering nozzle and the second steering to an opposite side of movement of the first vessel control apparatus along the transverse axis.

28. The method of claim 1, wherein the act of receiving a second vessel control signal corresponds to movement of a second vessel control apparatus along a rotational degree of freedom.

29. The method of claim 1, wherein the acts of receiving the first vessel control signal and receiving the second vessel control signal comprise receiving the first and second vessel control signals from a first vessel control apparatus having three degrees of freedom.

30. A system for controlling a marine vessel having a first steering nozzle, a reversing bucket and one of a bow thruster and a second steering nozzle, comprising:

a first vessel control apparatus having at least two degrees of freedom and providing a first vessel control signal corresponding to a movement of the first vessel control apparatus along at least one degree of freedom;

a second vessel control apparatus having a third degree of freedom and providing a second vessel control signal corresponding to movement of the second vessel control apparatus along the third degree of freedom; and a processor that receives the first vessel control signal and the second vessel control signal and that is configured to provide at least a first actuator control signal and a second actuator control signal;

wherein the first actuator control signal is coupled to and controls the first steering nozzle and the second actuator control signal is coupled to and controls one of the second steering nozzle, the reversing bucket, and the bow thruster;

wherein the processor is configured to provide the first actuator control signal and the second actuator control signal such that substantially no net rotational force is induced to the marine vessel as a result of movement of the first vessel control apparatus and with the second vessel control apparatus in a neutral position; and wherein the processor is configured to provide the first actuator control signal and the second actuator control signal so that a net force is induced to the marine vessel in substantially a same direction as movement of the first vessel control apparatus and the second vessel control apparatus, for all movements of the first vessel control apparatus along the at least two degrees of freedom and for all movements of the second vessel control apparatus along the third degree of freedom.

31. The system of claim 30, wherein the processor is programmed with at least one algorithm to provide the first and second actuator control signals in response to receiving the first vessel control signal as an input so as to induce the net translational force to the marine vessel substantially along the same direction as the first vessel control apparatus.

32. The system of claim 30, wherein the processor is adapted for calibrating the actuator control signals during a reference maneuver of the marine vessel.

33. The system of claim 30, wherein the first vessel control apparatus comprises a two-axis control stick.

34. The system of claim 30, wherein the processor is configured to provide the first actuator control signal and the second actuator control signal such that a first axis of the two-axis control stick controls a net lateral force applied to the marine vessel and a second axis of the two-axis control stick controls a net fore-and-aft force applied to the marine vessel.

35. The system of claim 30, wherein the processor is configured to provide a third actuator control signal and the vessel comprises a prime mover responsive to and controlled by the third actuator control signal.

36. The system of claim 30, further comprising an interface, coupled to the processor, that provides for communication with a personal digital assistant (PDA).

37. The system of claim 30, wherein the reversing bucket is constrained to substantially only one degree of freedom to provide varying amounts of thrust.

38. The system of claim 30, wherein the first steering nozzle and the second steering nozzle are configured such that the two steering nozzles rotate substantially in unison.

39. The system of claim 30, wherein the processor is configured to provide at least one of the first actuator control signal and the second actuator control signal to induce a rotational force in the marine vessel corresponding to movement of the second vessel control apparatus along the third degree of freedom without substantially inducing any net translational force to the marine vessel, for the first vessel control apparatus in a neutral position.

40. The system of claim 30, wherein the processor is further configured to automatically record key parameters of any of the first and second steering nozzles, the reversing bucket and the bow thruster during a reference maneuver of the marine vessel.

41. The system of claim 40, wherein the processor is further configured to automatically implement the key parameters to control the marine vessel to perform a maneuver of the marine vessel that corresponds to the reference maneuver.

42. The system of claim 30, further comprising an input device coupled to the processor, and wherein the processor is further configured to record key parameters of any of the first and second steering nozzles, the reversing bucket and the bow thruster in response to actuation of the input device.

43. The system of claim 30, comprising the bow thruster, the reversing bucket and the first steering nozzle, wherein the first vessel control apparatus is a joystick, and wherein the processor is configured to control a combination of the first steering nozzle and the reversing bucket and the bow thruster to induce substantially only a transverse force to the marine vessel with movement of the joystick along only a transverse axis and the second control apparatus being in a neutral position.

44. The system of claim 43, wherein the processor is configured to provide the first actuator control signal and the second actuator control signal so as to simultaneously control a combination of the first steering nozzle and the reversing bucket and the bow thruster to induce substantially only the transverse force to the marine vessel with movement of the joystick along only the transverse axis and the second control apparatus being in the neutral position.

45. The system of claim 30, wherein the processor is configured to provide the first and second actuator control signals to induce a transverse force from each of a combination of the first steering nozzle and the reversing bucket and the bow thruster that are equal when the second control apparatus is in a neutral position.

46. The system of claim 30, wherein the processor is configured in response to the second vessel control signal, to modify the first and second actuator control signals so as to create a differential thrust between a combination of the first steering nozzle and the reversing bucket and the bow thruster so as to induce a rotational force to the marine vessel.

47. The system of claim 30, wherein the marine vessel comprises the first steering nozzle and the second steering nozzle, and wherein the processor is configured so as to maintain the first and second steering nozzles at a fixed position for all movements of the first vessel control apparatus to one of a port and starboard side of a neutral position, while maintaining the second vessel control apparatus at a fixed position.

48. The system of claim 30, wherein the processor is configured, in response to the second vessel control signal, to induce a change in a deflection angle of the first steering nozzle.

49. The system of claim 30, wherein marine vessel comprises the first and second steering nozzles and the reversing bucket and a second reversing bucket, and wherein the processor is configured to actuate the first steering nozzle in combination with the reversing bucket to provide a reverse thrusting waterjet and to actuate the second steering nozzle in combination with the second reversing bucket to provide a forward thrusting waterjet, in response to transverse motion of the first vessel control apparatus, and wherein the processor is configured to provide an angle of the first steering nozzle, measured from a straight ahead position, that is less than an angle of the second steering nozzle, measured from the straight ahead position.

50. The system of claim 49, wherein the reverse thrusting waterjet is configured with a first revolutions per minute (RPM) value, and the forward thrusting waterjet is configured with a second RPM value, wherein the first RPM value is higher than the second RPM value.

51. The system of claim 30, wherein the first vessel control signal comprises two vessel control signals, each signal corresponding to a single degree of freedom of the first vessel control apparatus.

52. The system as claimed in claim 30, wherein the processor is further configured point the first steering nozzle and the second steering nozzle to one of a port and starboard side in response to movement of the first vessel control apparatus along a transverse axis.

53. The method of claim 52, wherein the processor is further configured to point the first steering nozzle and the second steering nozzle to an opposite side of movement of the first vessel control apparatus along the transverse axis.

54. The system as claimed in claim 30, wherein the second vessel control apparatus has a rotational degree of freedom and provides the second vessel control signal corresponding to movement of the second vessel control apparatus along the rotational degree of freedom.

55. The system of claim 30, wherein the first vessel control apparatus and the second vessel control apparatus comprise a three-axis controller.

56. A system for controlling a marine vessel having first and second steering nozzles, and first and second reversing buckets, comprising:

a first vessel control apparatus having at least two degrees of freedom that provides a first vessel control signal corresponding to a movement of the first vessel control apparatus along at least one degree of freedom;

a second vessel control apparatus having a third degree of freedom and providing a second vessel control signal corresponding to movement of the second vessel control apparatus along the third degree of freedom; and a processor that receives the first vessel control signal and the second vessel control signal, and that is configured to provide a first set of actuator control signals and a second set of actuator control signals;

wherein the first set of actuator control signals are coupled to and control the first and second steering nozzles and the second set of actuator control signals are coupled to and control the first and second reversing buckets;

wherein the processor is configured to provide the first set of actuator control signals and the second set of actuator control signal so that substantially no net rotational force is induced to the marine vessel as a result of movement of the first vessel control apparatus and with the second vessel control apparatus in a neutral position; and wherein the processor is configured to provide the first set of actuator control signals and the second set of actuator control signals so that a net force is induced to marine vessel in substantially a same direction as movement of the first vessel control apparatus and the second vessel control apparatus, for all movements of the first vessel control apparatus along the at least two degrees of freedom and for all movements of the second vessel control apparatus along the third degree of freedom.

57. The system of claim 56, wherein the processor is programmed with at least one algorithm to provide the first and second sets of actuator control signals in response to receiving the first vessel control signal as an input, so as to induce the net translational force to the marine vessel substantially along the same direction as the first vessel control apparatus.

58. The system of claim 56, wherein the first vessel control apparatus comprises a two-axis control stick.

59. The system of claim 58, wherein the processor is configured to provide the first actuator control signals and the second actuator control signals such that a first axis of the two-axis control stick controls a net lateral force induced to the marine vessel and a second axis of the two-axis control stick controls a net fore-and-aft force induced to the marine vessel.

60. The system of claim 56, further comprising an interface, coupled to the processor, that provides for communication with a personal digital assistant (PDA).

61. The system of claim 56, wherein the first and second reversing buckets are constrained to substantially only one degree of freedom to provide varying amounts of thrust.

62. The system of claim 56, wherein the first and second steering nozzles are configured so that they rotate substantially in unison.

63. The system of claim 56, wherein the processor is configured to provide at least one of the first set of actuator control signals and the second set of actuator control signals to induce a net rotational force to the marine vessel corresponding to movement of the second vessel control apparatus along the third degree of freedom without substantially inducing any net translational force to the marine vessel, for the first vessel control apparatus in a neutral position.

64. The system of claim 56, wherein the processor is further configured to automatically record key parameters of any of the first and second steering nozzles and the first and second reversing buckets during a reference maneuver of the marine vessel.

65. The system of claim 64, wherein the processor is further configured to automatically implement the key parameters to control the marine vessel to perform a maneuver of the marine vessel that corresponds to the reference maneuver.

66. The system of claim 56, wherein the processor is configured to provide a third set of actuator control signals and the vessel comprises prime movers responsive to and controlled by the third actuator control signals.

67. The system of claim 56, wherein the processor is configured so as to maintain the first and second steering nozzles at a fixed position for all movements of the first vessel control apparatus to one of a port and starboard side of a neutral position, while maintaining the second vessel control apparatus at a fixed position.

68. The system of claim 56, wherein the processor is configured to actuate the first steering nozzle in combination with the first reversing bucket to provide a reverse thrusting waterjet and to actuate the second steering nozzle in combination with the second reversing bucket to provide a forward thrusting waterjet, in response to transverse motion of the joystick, and wherein the processor is configured to provide an angle of the first steering nozzle, measured from a straight ahead position, that is less than or equal to an angle of the second steering nozzle, measured from the straight ahead position.

69. The system of claim 68, wherein the reverse thrusting waterjet is configured with a first revolutions per minute (RPM) value, and the forward thrusting waterjet is configured with a second RPM value, wherein the first RPM value is higher than the second RPM value.

70. The system of claim 56, wherein the first vessel control signal comprises two vessel control signals, each signal corresponding to a single degree of freedom of the first vessel control apparatus.

71. The system as claimed in claim 56, wherein the processor is further configured to point the first steering nozzle and the second steering nozzle to one of a port and starboard side in response to movement of the first vessel control apparatus along a transverse axis.

72. The method of claim 71, wherein the processor is further configured to point the first steering nozzle and the second steering nozzle to an opposite side of movement of the first vessel control apparatus along the transverse axis.

73. The system as claimed in claim 56, wherein the second vessel control apparatus has a rotational degree of freedom and provides the second vessel control signal corresponding to movement of the second vessel control apparatus along the rotational degree of freedom.

74. A system for controlling a marine vessel having a first steering nozzle, a reversing bucket and a second steering nozzle, comprising:

a first vessel control apparatus having at least two degrees of freedom and providing a first vessel control signal corresponding to a movement of the first vessel control apparatus along at least one degree of freedom;

a second vessel control apparatus having a third degree of freedom and providing a second vessel control signal corresponding to movement of the second vessel control apparatus along the third degree of freedom; and a processor that receives the first vessel control signal and the second vessel control signal and that is configured to provide at least a first actuator control signal and a second actuator control signal;

wherein the first actuator control signal is coupled to and controls the first steering nozzle and the second actuator control signal is coupled to and controls one of the second steering nozzle, the reversing bucket, and the bow thruster;

wherein the processor is configured to provide the first actuator control signal and the second actuator control signal such that substantially no net rotational force is induced to the marine vessel as a result of movement of the first vessel control apparatus and with the second vessel control apparatus in a neutral position;

wherein the processor is configured to provide the first actuator control signal and the second actuator control signal so that a net force is induced to the marine vessel in substantially a same direction as movement of the first vessel control apparatus and the second vessel control apparatus, for all movements of the first vessel control apparatus along the at least two degrees of freedom and for all movements of the second vessel control apparatus along the third degree of freedom; and wherein the processor is configured to provide variations in transverse and longitudinal thrust to the marine vessel by varying a thrust magnitude of each propulsor corresponding to the first and second steering nozzles, while maintaining the first and second steering nozzles in the fixed position.

75. A system for controlling a marine vessel having first and second steering nozzles, and first and second reversing buckets, comprising:

a first vessel control apparatus having at least two degrees of freedom that provides a first vessel control signal corresponding to a movement of the first vessel control apparatus along at least one degree of freedom;

a second vessel control apparatus having a third degree of freedom and providing a second vessel control signal corresponding to movement of the second vessel control apparatus along the third degree of freedom; and a processor that receives the first vessel control signal and the second vessel control signal, and that is configured to provide a first set of actuator control signals and a second set of actuator control signals;

wherein the first set of actuator control signals are coupled to and control the first and second steering nozzles and the second set of actuator control signals are coupled to and control the first and second reversing buckets;

wherein the processor is configured to provide the first set of actuator control signals and the second set of actuator control signal so that substantially no net rotational force is induced to the marine vessel as a result of movement of the first vessel control apparatus and with the second vessel control apparatus in a neutral position;

wherein the processor is configured to provide the first set of actuator control signals and the second set of actuator control signals so that a net force is induced to marine vessel in substantially a same direction as movement of the first vessel control apparatus and the second vessel control apparatus, for all movements of the first vessel control apparatus along the at least two degrees of freedom and for all movements of the second vessel control apparatus along the third degree of freedom;

wherein the first vessel control apparatus is a joystick; and wherein the processor is configured to control a combination of the first steering nozzle and the first reversing bucket and a combination of the second steering nozzle and the second steering bucket to induce substantially only a transverse force to the marine vessel with movement of the joystick along only a transverse axis and the second control apparatus being in a neutral position.

76. A system for controlling a marine vessel having first and second steering nozzles, and first and second reversing buckets, comprising:

a first vessel control apparatus having at least two degrees of freedom that provides a first vessel control signal corresponding to a movement of the first vessel control apparatus along at least one degree of freedom;

a second vessel control apparatus having a third degree of freedom and providing a second vessel control signal corresponding to movement of the second vessel control apparatus along the third degree of freedom; and a processor that receives the first vessel control signal and the second vessel control signal, and that is configured to provide a first set of actuator control signals and a second set of actuator control signals;

wherein the first set of actuator control signals are coupled to and control the first and second steering nozzles and the second set of actuator control signals are coupled to and control the first and second reversing buckets;

wherein the processor is configured to provide the first set of actuator control signals and the second set of actuator control signal so that substantially no net rotational force is induced to the marine vessel as a result of movement of the first vessel control apparatus and with the second vessel control apparatus in a neutral position;

wherein the processor is configured to provide the first set of actuator control signals and the second set of actuator control signals so that a net force is induced to marine vessel in substantially a same direction as movement of the first vessel control apparatus and the second vessel control apparatus, for all movements of the first vessel control apparatus along the at least two degrees of freedom and for all movements of the second vessel control apparatus along the third degree of freedom; and wherein the processor is configured to provide variations in transverse and longitudinal thrust to the marine vessel by varying a thrust magnitude of each propulsor corresponding to the first and second steering nozzles, while maintaining the first and second steering nozzles in a fixed position.

77. A marine vessel control system for a marine vessel comprising a first-steering nozzle and a bow thruster, the marine vessel control system comprising:

a first vessel control apparatus having at least two degrees of freedom that provides a first vessel control signal corresponding to movement of the first vessel control apparatus along at least one degree of freedom;

a second vessel control apparatus having a third degree of freedom and providing a second vessel control signal corresponding to movement of the second vessel control apparatus along the third degree of freedom; and a processor that receives the first vessel control signal and that is configured to provide at least a first actuator control signal and a second actuator control signal;

wherein the first actuator control signal is coupled to and controls the first steering nozzle, and wherein the second actuator control signal is coupled to and controls the bow thruster;

wherein the processor is configured to induce a net translational force to the vessel primarily in a direction corresponding to the movement of the vessel control apparatus, and such that substantially no net rotational force is induced to the marine vessel as a result of movement of the first vessel control apparatus; and wherein the processor is configured to provide the first actuator control signal and the second actuator control signal so that a net force is induced to the marine vessel in substantially a same direction as movement of the first vessel control apparatus and the second vessel control apparatus, for all movements of the first vessel control apparatus along the at least two degrees of freedom and for all movements of the second vessel control apparatus along the third degree of freedom.

78. The system of claim 77, wherein the processor is further configured to automatically record key parameters of any of the first steering nozzle and the bow thruster during a reference maneuver of the marine vessel.

79. The system of claim 78, wherein the processor is further configured to automatically implement the key parameters to control the marine vessel to perform a maneuver of the marine vessel that corresponds to the reference maneuver.

80. The system of claim 77, further comprising an input device coupled to the processor, and wherein the processor is further configured to record key parameters of any of the first steering nozzle and the bow thruster in response to actuation of the input device.

81. The system of claim 77, wherein the processor is programmed with at least one algorithm to provide the first and second actuator control signals in response to receiving the first vessel control signal as an input so as to induce the net translational force to the marine vessel substantially along the same direction as the first vessel control apparatus.

82. The system of claim 77, wherein the first vessel control apparatus comprises a two-axis control stick.

83. The system of claim 77, wherein the processor is configured to provide the first actuator control signal and the second actuator control signal such that a first axis of the two-axis control stick controls a net lateral force induced to the marine vessel and a second axis of the two-axis control stick controls a net fore-and-aft force induced to the marine vessel.

84. The system of claim 77, wherein the net force induced to the marine vessel and the movement of the first vessel control apparatus are in substantially similar directions with respect to a stationary frame of reference.

85. The system of claim 77, wherein the system includes a reversing bucket that is constrained to substantially only one degree of freedom to provide varying amounts of thrust.

86. The system of claim 77, wherein the processor is configured to provide the first actuator control signal and the second actuator control signal so as to simultaneously control a combination of the first steering nozzle and the bow thruster.

87. The system of claim 77, further comprising a reversing bucket, wherein the processor is configured to provide the first and second actuator control signals to provide a transverse thrust from a combination of the first steering nozzle and the reversing bucket and the bow thruster that are equal when the second vessel control apparatus is in a neutral position.

88. The system of claim 77, further comprising a reversing bucket, wherein the processor is configured in response to the second vessel control signal, to modify the first and second actuator control signals so as to create a differential thrust between a combination of the first steering nozzle and the reversing bucket and the bow thruster so as to induce a net rotational force to the marine vessel.

89. The system of claim 77, wherein the processor is configured, in response to the second vessel control signal, to induce a change in a deflection angle of the first-steering nozzle.

90. The system of claim 77, wherein the first vessel control signal comprises two vessel control signals, each signal corresponding to a single degree of freedom of the first vessel control apparatus.

91. The system of claim 77, wherein the first vessel control apparatus and the second vessel control apparatus comprise a three-axis controller.

92. A system for controlling a marine vessel having first and second steering nozzles, and first and second reversing buckets, comprising:

a first vessel control apparatus having at least two degrees of freedom that provides a first vessel control signal corresponding to a movement of the first vessel control apparatus along at least one degree of freedom;

a second vessel control apparatus having a third degree of freedom and providing a second vessel control signal corresponding to movement of the second vessel control apparatus along the third degree of freedom; and a processor that receives the first vessel control signal and the second vessel control signal, and that is configured to provide a first set of actuator control signals and a second set of actuator control signals;

wherein the first set of actuator control signals are coupled to and control the first and second steering nozzles and the second set of actuator control signals are coupled to and control the first and second reversing buckets;

wherein the processor is configured to provide the first set of actuator control signals and the second set of actuator control signal so that substantially no net rotational force is induced to the marine vessel as a result of movement of the first vessel control apparatus and with the second vessel control apparatus in a neutral position;

wherein the processor is configured to provide the first set of actuator control signals and the second set of actuator control signals so that a net force is induced to marine vessel in substantially a same direction as movement of the first vessel control apparatus and the second vessel control apparatus, for all movements of the first vessel control apparatus along the at least two degrees of freedom and for all movements of the second vessel control apparatus along the third degree of freedom; and wherein the first vessel control apparatus and the second vessel control apparatus comprise a three-axis controller.

* * * * *

UNITED STATES PATENT AND TRADEMARK OFFICE

CERTIFICATE OF CORRECTION

PATENT NO. : 7,037,150 B2
APPLICATION NO. : 10/261048
DATED : May 2, 2006
INVENTOR(S) : Robert A. Morvillo It is certified that error appears in the above-identified patent and that said Letters Patent is hereby corrected as shown below:

In column 34, line 21, delete the numeral "30" and insert the numeral --33--.

Signed and Sealed this

Sixteenth Day of February, 2010

David J. Kappos

David J. Kappos
*Director of the United States Patent and Trademark Office*